US005876568A

United States Patent [19]

Kindersley

[11] Patent Number: 5,876,568

[45] Date of Patent: Mar. 2, 1999

[54] SAFE AND SEMI-AUTOMATIC REMOVAL OF HEAVY DRUM CLOSURES

[76] Inventor: Peter Kindersley, P.O. Box 3201, Glens Falls, N.Y. 12801

[21] Appl. No.: 899,609

[22] Filed: Jul. 24, 1997

Related U.S. Application Data

[60] Provisional application No. 60/022,628, Jul. 25, 1996.

[51] Int. Cl.[6] ..... C10B 25/00; C10B 33/00; B65B 7/00

[52] U.S. Cl. ..... 202/242; 202/252; 202/262; 202/269; 202/270; 220/4.33; 220/200; 220/260; 220/304; 220/324; 220/916; 292/256.6; 29/426.5; 414/411

[58] Field of Search ..... 202/241, 242, 202/252, 262, 269, 270; 49/463, 469, 479.1; 292/254, 256.6; 29/426.3, 426.5; 414/411; 220/4.33, 200, 260, 304, 324, 325, 328, 916

[56] References Cited

U.S. PATENT DOCUMENTS

| | | | |
|---|---|---|---|
| 4,726,109 | 2/1988 | Malsbury et al. | 29/402.08 |
| 4,960,358 | 10/1990 | DiGiacomo et al. | 414/684.3 |
| 5,098,524 | 3/1992 | Antalfy et al. | 202/96 |
| 5,228,825 | 7/1993 | Fruchtbaum et al. | 414/684.3 |
| 5,290,076 | 3/1994 | Smith | 292/25 |
| 5,500,094 | 3/1996 | Fruchtbaum et al. | 202/241 |

OTHER PUBLICATIONS

Grayloc® product bulletin "The Grayloc Metal to Metal Seal", 1995.

*Primary Examiner*—Bekir L. Yildirim
*Attorney, Agent, or Firm*—Nixon & Vanderhye P.C.

[57] ABSTRACT

In a coke drum an outlet arrangement is provided which allows removal of the coke from the drum without endangering the health or safety of workers heading or unheading the coke drum. Instead of using a manually removable bottom flange for the drum, a semiautomatic bottom flange removal system is provided. A spool is attached to the conventional, pre-existing, about 6 feet in diameter drum stationary bottom flange. The spool includes a tapered clamping surface. A new style removable bottom flange also includes a tapered clamping surface. The tapered clamping surfaces cooperate with clamp ring sectors movable by externally mounted hydraulic cylinders into contact with the spool and the flange, and other hydraulic cylinders mounted directly on the ring sectors move male locking surfaces into locking engagement with cooperating female locking surfaces formed on adjacent clamp ring sectors.

20 Claims, 22 Drawing Sheets

SAFE AND SEMI-AUTOMATIC REMOVAL OF HEAVY DRUM CLOSURES

CROSS-REFERENCE TO RELATED APPLICATION

This application claims the benefit of provisional application Ser. No. 60/022,628 filed Jul. 25, 1996.

BACKGROUND AND SUMMARY OF THE INVENTION

In the field of producing petroleum coke in an oil refinery, a process called delayed coking is in common and growing use. Heavy residual oil from the bottom of the fractionator column is heated to about 950 degrees F., some chemicals are added, and the fluid is pumped into a large alloy steel drum. The drum is commonly 25 to 27 feet in diameter and two to three times as tall. The liquid turns into hard coke inside the drum, when it becomes stagnant, by the hydrocarbon cracking process, releasing light hydrocarbon products and leaving coke as the low grade residual product in the drum. To remove the hard coke, it must be cut out of the drum with high pressure water, cutting the hard coke into pieces that can fall out the bottom of the drum.

To cut coke out of a drum that is full, a three foot flange is removed from the top of the drum and a six foot flange is removed from the bottom of the drum. A rotating combination drill bit and cutting head about 18" diameter is mounted on the lower end of a long hollow drill rod about 6" in diameter, and the drill bit is then lowered into the drum, on the drill stem, through the three foot flange opening at the top. A hole about 18" in diameter is drilled down through the entire vertical height of the coke in the drum, the drill bit coming out through the bottom of the hard coke mass. Then the rotating drill is raised back up a short distance into the hard coke mass, and high pressure water at about 2500 psi and more is pumped down the hollow drill rod, and out a group of positioned jet nozzles in the sides of the cutting head part of the drill bit. The nozzles shoot jets of water horizontally outwards, rotating slowly with the drill rod, and those jets cut the coke into pieces, which fall out the open bottom of the drum, into a pit. The drill is raised slowly up from the bottom the entire vertical height of the coke mass, cutting the coke out of the drum all the way up to the top, the coke falling out the six foot opening at the bottom of the drum. The drill rod is then withdrawn out the three foot flange opening at the top of the drum. The six foot flange at the bottom of the drum is then bolted back in place, along with the three foot flange at the top of the drum. The drum is then clean and ready for the next filling cycle with the heavy residual oil.

The process of removing and replacing the removable six foot flange or cover is called heading and unheading. The removable flange or cover is manually bolted on and unbolted from a stationary complimentary six foot flange at the bottom of the vessel, using air wrenches, on over seventy large nuts. It is dangerous work, with several risks associated with the procedures. There have been fatalities, and many burns suffered, and there is significant physical trauma associated with the manual work.

So unpleasant is the above-described work of unheading and heading of the six foot flange, it is frequently subcontracted by the refineries to outside contractors, who employ workers specialized in this difficult work. Other refineries have their own employees perform the work, but they rotate the workers frequently to other tasks, so as to minimize the effects of the harmful trauma.

For the above reasons, the oil refineries with delayed coker process units universally desire to automate the unheading procedure, to minimize the strenuous manual work and risk of accidents therefrom.

There are currently two known devices on the market to facilitate heading and unheading. One, a clam shell type of hinged bottom cover, swings down and away under hydraulic power, opening the bottom of the drum for the coke to drop out. It is very big and heavy, requires much structural support to be added to existing drums at considerable expense, and in many cases is even impossible to implement because of limited strength of the existing drums. Of great importance is the difficulty in this design to develop the required large force, typically about 1,000,000 pounds, required to hold the bottom flange to the bottom of the drum with sufficient force to develop the needed gasket squeeze. It has received very little acceptance. The other device has been sold in many refineries, and is the device of choice at present. It has a flange that is held up against the bottom of the vessel with tensioned bolts. Instead of tensioning them with a threaded nut, as in a bolt on the manually installed flanges, the bolts are tensioned by stretching them with an inflatable hollow ring of gas-filled metal. Then a mechanical locking ring is positioned so that the tension is maintained by the mechanical locks being put into place. The device is complicated, with several hundred moving parts, and is quite expensive, about $1,000,000 each. It also is very expensive to install, and takes a long time to complete all the work, at great cost in lost production. While new drums can be designed to use the device, it is difficult to add to existing installations.

The invention relates to an alternative device (and method) for removing and replacing flanges, particularly six foot flanges, for coke drums and the like, that is simple, compact, quick and easy to install, uses existing technology, is less expensive than prior art alternatives discussed above, and is particularly well suited to being retrofitted to existing drums (as well as usable in new installations). The invention seeks to make the heading and unheading of delayed coker drums safer for personnel to perform, by removing the source of severe work-related trauma to personnel. This is accomplished through a novel means of automated clamping of the removable six foot flange firmly to the stationary flange at the bottom of the drum. The invention also speeds up the procedure so that the cycle time for the process can be reduced, without compromise in safety or human effort. The invention also renders the addition of this new closure device onto the hundreds of existing coker drums to a simple, quick, and inexpensive procedure, as compared to the difficult, expensive, and time consuming requirement of the inflatable hollow ring device of the prior art described above. The invention dramatically increases the closure integrity, and therefore the safety, of the large gasket for the six foot flange; and the invention provides a mechanism that can be cleared easily, with an air hose or steam jet just before heading, of any fallen coke accumulations that commonly foul mechanisms of the prior art.

The invention relates to a method and apparatus for semi-automatically clamping and unclamping distinct elements together so as to effect ready removal of a closure for a drum, in place of the removable flange or closure described above, and without the drawbacks discussed above. In the preferred embodiment three or four clamping ring sectors are provided associated with a spool piece (adaptor) and revised closure flange which takes the place of the prior art removable closure flange, the spool piece bolted to the stationary drum flange and the revised closure flange being capable of being made from the prior art closure flange in existing installations. However two clamping ring sectors might be used in some installations, or more than three or four (e. g. 6–8). Powered devices, which may be controlled automatically or semi-automatically, move the clamping ring sections between a position in which they clamp the revised closure flange in place to the spool piece portion of the stationary flange on the drum, and a position in which they release the revised closure flange. The powered devices may comprise any powered actuators, including motors, solenoids, or the like, but preferably comprises linear actuators such as hydraulic or pneumatic cylinders with reciprocating piston rods. Other actuators, which also may include motors, solenoids, or the like, but preferably comprise linear actuators such as hydraulic or pneumatic cylinders with reciprocating piston rods, may be mounted on the drum or other stationary location to move the clamping ring sectors out of the way when clamping action is released, so that the revised closure flange may be supported by conventional existing vertically movable supports (e. g. fluidic cylinders). The method of the invention typically requires human intervention only to remove a small number of easily removed jamming pins, and to actuate the powered devices, all of which can be done safely and without significant or dangerous physical effort. The drum cleaning procedure may then be performed just as in the prior art procedure described above.

According to one aspect of the present invention, there is provided a method of modifying an existing substantially vertical coke drum to semi-automate heading and unheading, the coke drum having a bottom stationary flange having a plurality of substantially vertical openings through which bolts pass, and a bottom removable flange at least forty inches in diameter and having a plurality of substantially vertical openings therein to receive the bolts which pass through the stationary flange openings and having a conduit through which hydrocarbon fluids pass during coke production, the method utilizing a spool piece having a generally upwardly facing annular tapered clamping surface, a plurality of clamp ring sectors each having spaced first locking surfaces and generally downwardly and upwardly annular sector tapered clamping surfaces, a plurality of second locking surfaces; a plurality of first powered actuators for moving the second locking surfaces, and a plurality of second powered actuators for moving the clamp ring sectors. The method comprises the steps of: (a) detaching the bottom removable flange and hydrocarbon fluid conduit from the coke drum bottom stationary flange; (b) forming a generally downwardly facing annular tapered clamping surface on the bottom removable flange, to produce a revised removable flange, or replacing the bottom removable flange with a new flange having a generally downwardly facing annular tapered clamping surface, and a hydrocarbon fluid conduit; (c) attaching the spool piece to the drum stationary flange; (d) attaching the plurality of second actuators to the drum; (e) moving the revised or new movable flange into sealing engagement with the spool piece; (f) using the second powered actuators, moving the tapered clamping surfaces of the clamp ring sectors into contact with the tapered clamping surfaces of the spool piece and the revised or new removable flange; and (g) using the first powered actuators, moving the first locking surfaces into locking engagement with the second locking surfaces.

The tapered annular clamping surfaces of the revised or new bottom flange and spool piece may have a first radius of curvature, and the clamp ring sectors tapered annular sector clamping surfaces may have a second radius of curvature, approximately 2–13% greater than the first radius; and wherein step (f) may be practiced so as to cause a center portion only of each clamp ring sector tapered annular sector to contact the spool piece and revised or new bottom flange tapered annular clamping surfaces; and wherein step (g) may be practiced to cause the clamp ring sectors to bend to cause end portions thereof to come into contact with the spool piece and revised or new bottom flange tapered annular clamping surfaces and provide the desired effective clamping force at the center portion.

Step (c) may be practiced by connecting the bolts from the drum flange to the spool piece using nuts. There may also be the further steps of (h) unheading the drum by first moving the first powered actuators to move the first and second locking surfaces out of locking engagement with each other, and then (i) using the second powered actuators, moving the ring clamp sectors away from the drum while the revised or new bottom flange is supported by an external support, so that the bottom flange is free to move away from the drum upon movement of the external support.

There may also be the further steps of: (j) moving the bottom flange away from the drum so that an opening at least 30 inches (preferably at least 40 inches, more desirably at least 60 inches, most desirably about 72 inches) in diameter is provided in the bottom of the drum, (k) removing coke from the drum through the bottom opening (using the conventional techniques described above); and (l) repeating steps (e)–(g) to move and seal the bottom flange back into a position covering the opening in the bottom of the drum.

Typically, the first actuators comprise linear actuators connected to the first locking surfaces by a linkage, and each of the linkages is connected to a ring clamp sector using a removable jamming pin; and comprising the further step (j), before step (i), of removing the jamming pins.

According to another aspect of the present invention a coke drum assembly is provided comprising the following components: A substantially vertical coke drum having a top with a removable top flange, a bottom with a stationary first sealing structure, and a movable second sealing structure (e. g. a removable bottom flange with a hydrocarbon fluid conduit therein) larger than the removable top flange that is adapted to be moved from a first position sealingly connected to the first sealing structure, and a second position detached from the first sealing structure. The first and second sealing structures having, respectively, first and second tapered annular clamping surfaces. A plurality (preferably 3 or 4, although 2, or 5–8, may be provided) of clamp ring sectors, each sector having third and fourth tapered annular sector clamping surfaces for respectively engaging the first and second tapered annular clamping surfaces. A plurality of first locking structures each having first locking surfaces. Second locking surfaces formed in each of the clamp ring sectors, the second locking surfaces for cooperation with the first locking surfaces to hold the clamp ring sectors to each other so that the clamp ring sectors hold the second sealing structure with respect to the first sealing structure in the first position. A plurality of first powered actuators mounted to the ring sectors and the first locking structure for moving the first locking structures with respect to the second locking surfaces between a first position in which the clamp ring sectors are clamped together, and a second position in which the clamp ring sectors are movable apart from each other; and a plurality of second powered actuators distinct from the first actuators and connected to the clamp ring sectors to move the clamp ring sectors away from the first and second sealing structures when the first locking structure is in the second position. The stationary first sealing structure may comprise a bottom flange of the drum, and a spool piece extending downwardly from the bottom flange; and wherein the movable second sealing structure comprises a movable flange. Each of the first powered actuators preferably comprises a linear actuator, and each of the plurality of second actuators comprises a linear actuator operatively connected adjacent one end thereof to the drum and adjacent another end thereof to a the clamp ring sector. For example, each of the first powered linear actuators is connected to the first locking structure by a linkage, and the linkage is releasably connected to a the clamp ring section by a removable jam pin.

Preferably the first locking surfaces are male surfaces, and the second locking surfaces are female, although they may be switched, or mixed. To enhance clamping efficiency while minimizing the number of clamp ring sectors, preferably the first and second tapered annular clamping surfaces have a first radius of curvature, and the clamp ring sectors tapered annular sector clamping surfaces having a second radius of curvature, approximately 2–13%, preferably 5–10%, greater than the first radius so as to cause only a center portion of each clamp ring sector tapered annular sector to contact the first and second tapered annular clamping surfaces, and to cause the clamp ring sectors to bend to cause end portions thereof to come into contact with the first and second tapered annular clamping surfaces and provide the desired effective clamping force at the center portion.

In one preferred embodiment, each of the first locking structures comprises a relatively stationary locking surface spaced from a relatively movable locking surface, the relatively movable locking surface mounted on a pivotal link operatively connected a one of the first actuators. Also, typically the second movable sealing structure comprises a bottom flange generally circular in dimension and having a diameter of over about five feet [60 inches], typically about 72 inches or even greater in diameter.

The invention is advantageous compared to other known clamping systems. For example the Grayloc® connector (available from Gray Tool Co. of Harvey, La.) connects a tapered inner surface clamp by bolts to tapered outer surface hubs (or hub pieces), with a distinct, ribbed, metal seal ring between the hubs. Thus operation is not semi-automatic, an extra large component (the ribbed seal ring) is provided, and known maximum size is 30 inch diameter hubs. The invention, on the other hand, uses only a thin, flat, metal gasket recessed in one or more main grooves formed in the spool piece and bottom flange, is used with 72" diameter clamped components, and is semi-automatic (virtually automatic) in operation. The main grooves may include relief grooves connected to a source of steam.

According to another aspect of the invention there is provided a semi-automatic clamping assembly comprising the following components: A stationary first sealing structure (e. g. a stationary bottom flange of a coke drum, with a spool). A movable second sealing structure (e. g. a bottom removable flange) that is adapted to be moved between a first position sealingly connected to the first sealing structure, and a second position detached from the first sealing structure, the second sealing structure having a diameter of over about thirty inches (preferably over 36 inches, more preferably over 60 inches, e. g. about 72 inches or more). The first and second sealing structures having, respectively, first and second tapered annular clamping surfaces. A plurality of clamp ring sectors, each sector having third and fourth tapered annular sector clamping surfaces for respectively engaging the first and second tapered annular clamping surfaces. A plurality of first locking structures each having first locking surfaces. Second locking surfaces formed in each of the clamp ring sectors, the second locking surfaces for cooperation with the first locking surfaces to hold the clamp ring sectors to each other so that the clamp ring sectors hold the second sealing structure with respect to the first sealing structure in the first position. A plurality of first powered actuators mounted to the ring sectors and the first locking structure for moving the first locking structures with respect to the second locking surfaces between a first position in which the clamp ring sectors are clamped together, and a second position in which the clamp ring sectors are movable apart from each other; and a plurality of second powered actuators distinct from the first actuators and connected to the clamp ring sectors to move the clamp ring sectors away from the first and second sealing structures when the first locking structure is in the second position.

The details of the components are preferably as described above with respect to an earlier aspect of the invention.

According to yet another aspect of the present invention, there is provided an assembly for providing substantially leak-proof sealing of a volume (e. g. a coke drum) in general. The assembly comprises the following components: A volume having fluent material at a first pressure. First and second substantially annular flanges having face-to-face engagement along first and second surfaces thereof, the surfaces abutting the inner volume at a first end portion thereof, and abutting an exterior volume at a second end portion thereof. First and second main substantially annular grooves formed in the first and second surfaces, respectively. A relief groove formed in each of the main grooves. An annular metal gasket disposed in the main grooves, the gasket having a plurality of through extending openings therein extending from one relief groove to the other; and a passage extending through one of the flanges and connected to a source of steam at a second pressure, higher than the first pressure, so that steam is supplied to the relief grooves and if there is leakage between the first and second surfaces it is of steam.

It is the primary object of the present invention to provide for the heading and unheading of coke drums in a semi-automatic safe, easy, and quick manner. This and other objects of the invention will become clear from a detailed description of the invention, and from the appended claims.

DETAILED DESCRIPTION OF THE DRAWINGS

Figure 1:
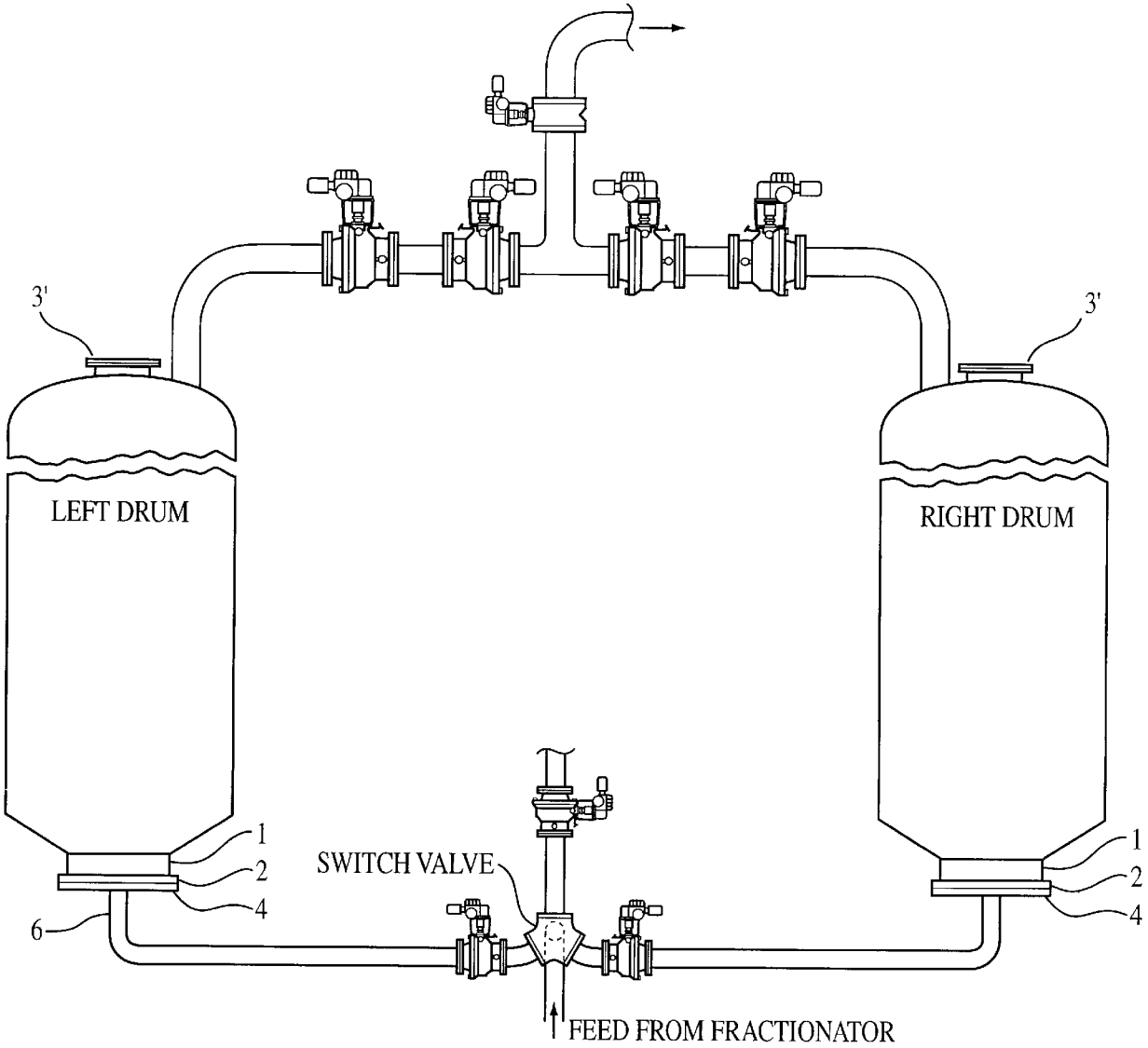
FIG. 1 PRIOR ART
FIG. 1 is a side schematic view that shows an exemplary prior art delayed coker process unit, with feed of oil, a switching valve that diverts it to the left drum or the right drum, the two drums, and the exit piping that goes to a common tee plus the selector valves that connect whichever drum is being filled.

FIG. 1 is a schematic side view of a conventional delayed coker process unit using left and right drums, each having a bottom 1. The six foot flanges which are dealt with according to the present invention include a stationary flange 2 and a removable closure flange 4, at each bottom 1 of the drums, while the three foot flange is shown by reference numeral 3' at the top of each drum. The feed from the fractionator passes through pipes through the flanges 2, 4 (e. g. through conduit 6), into a bottom of the appropriate drum depending upon the position of the switch valve, while the material after treatment exits through piping at the tops of the drums, through conventional valves.

Figure 2A:
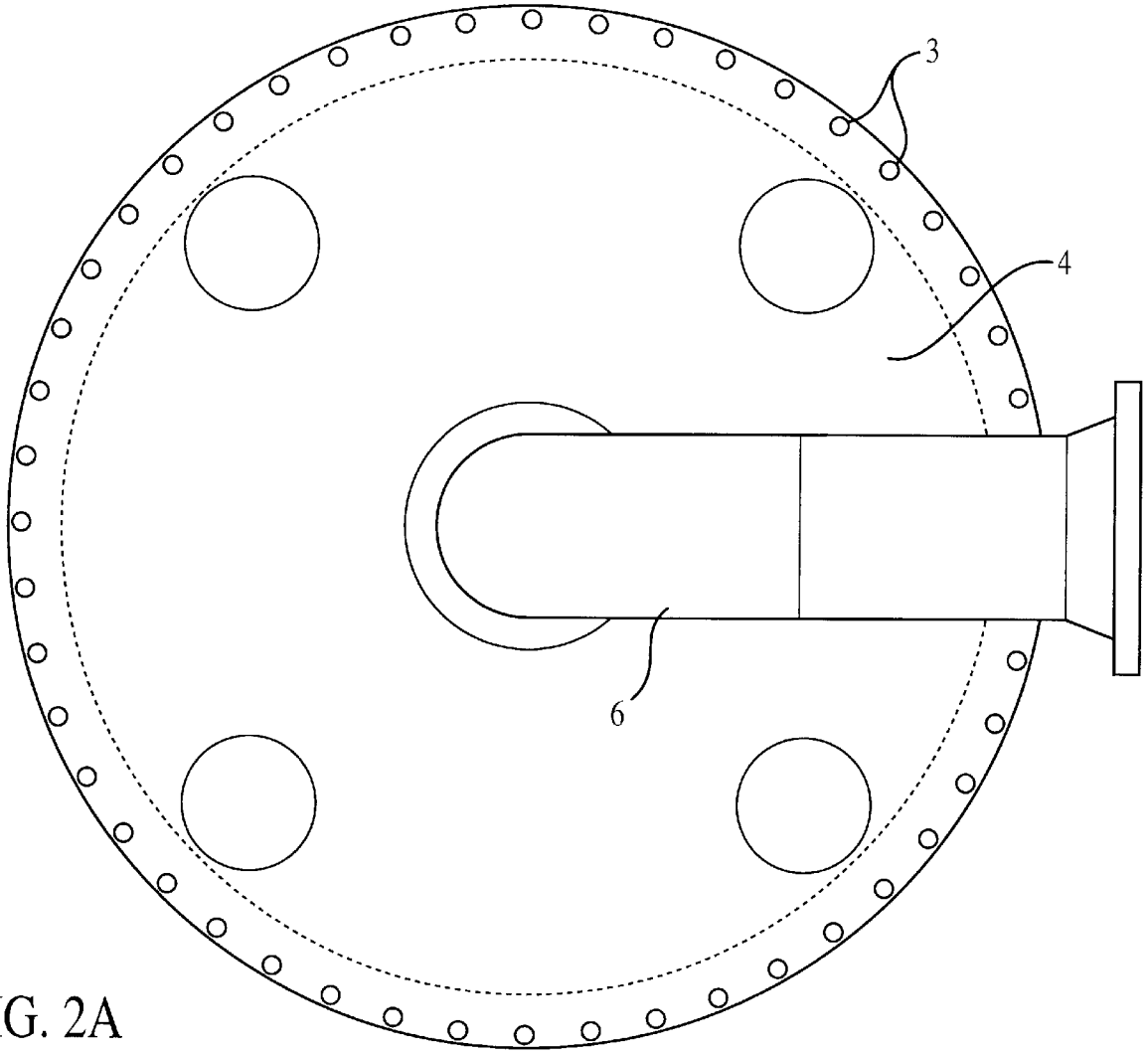
FIG. 2A PRIOR ART
FIG. 2A is a bottom view of the closure of the six foot flange of each conventional drum of FIG. 1, and FIGS. 2B and 2C together illustrate the six foot flange mounted at this lower end, the traditional manually-bolted closure flange, and the multitude of nuts and studs that must be manually fastened and unfastened at each cycle.
Figure 2B:
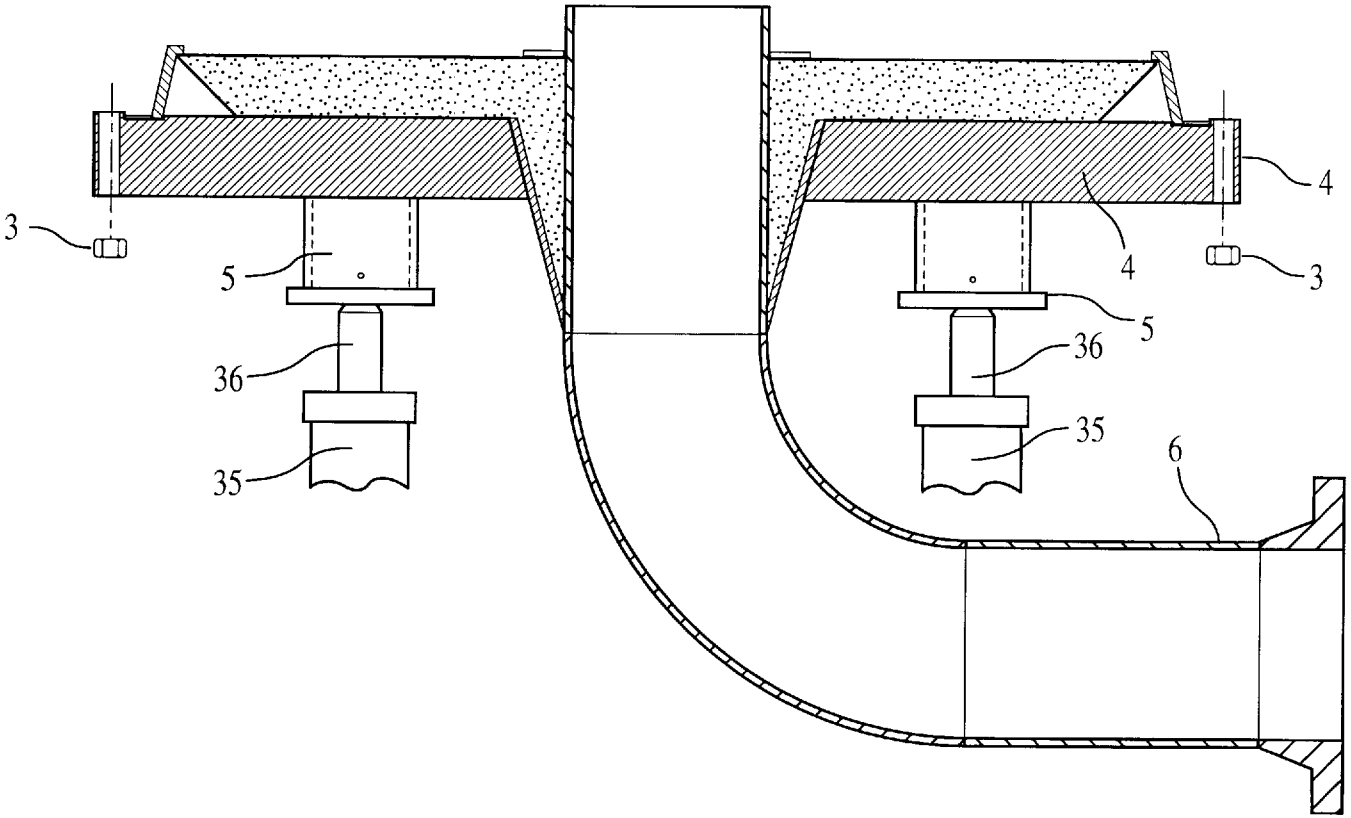
FIG. 2B PRIOR ART
Figure 2C:
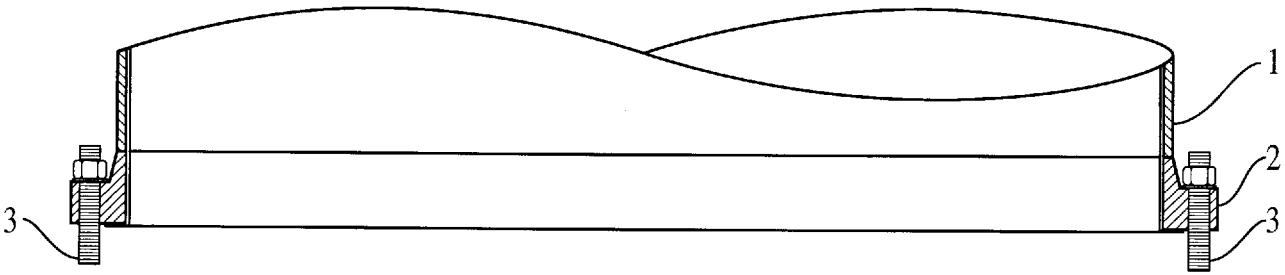
FIG. 2C PRIOR ART

FIGS. 2A–C show a conventional prior art closure flange 4 being raised into position by cylinders 35 and piston rods 36, which engage supports 5 extending downwardly from the bottom of flange 4. After flange 4 is in the raised position, the complete set of conventional studs and nuts 3 must be installed and tightened, using heavy air wrenches. [Note that this same flange lifting system 35, 36 is retained in use in conjunction with the subject invention automated clamping of a revised flange. After the revised flange of the invention is lifted into position, the automated clamping system of the invention is put into use.]

Figure 3:
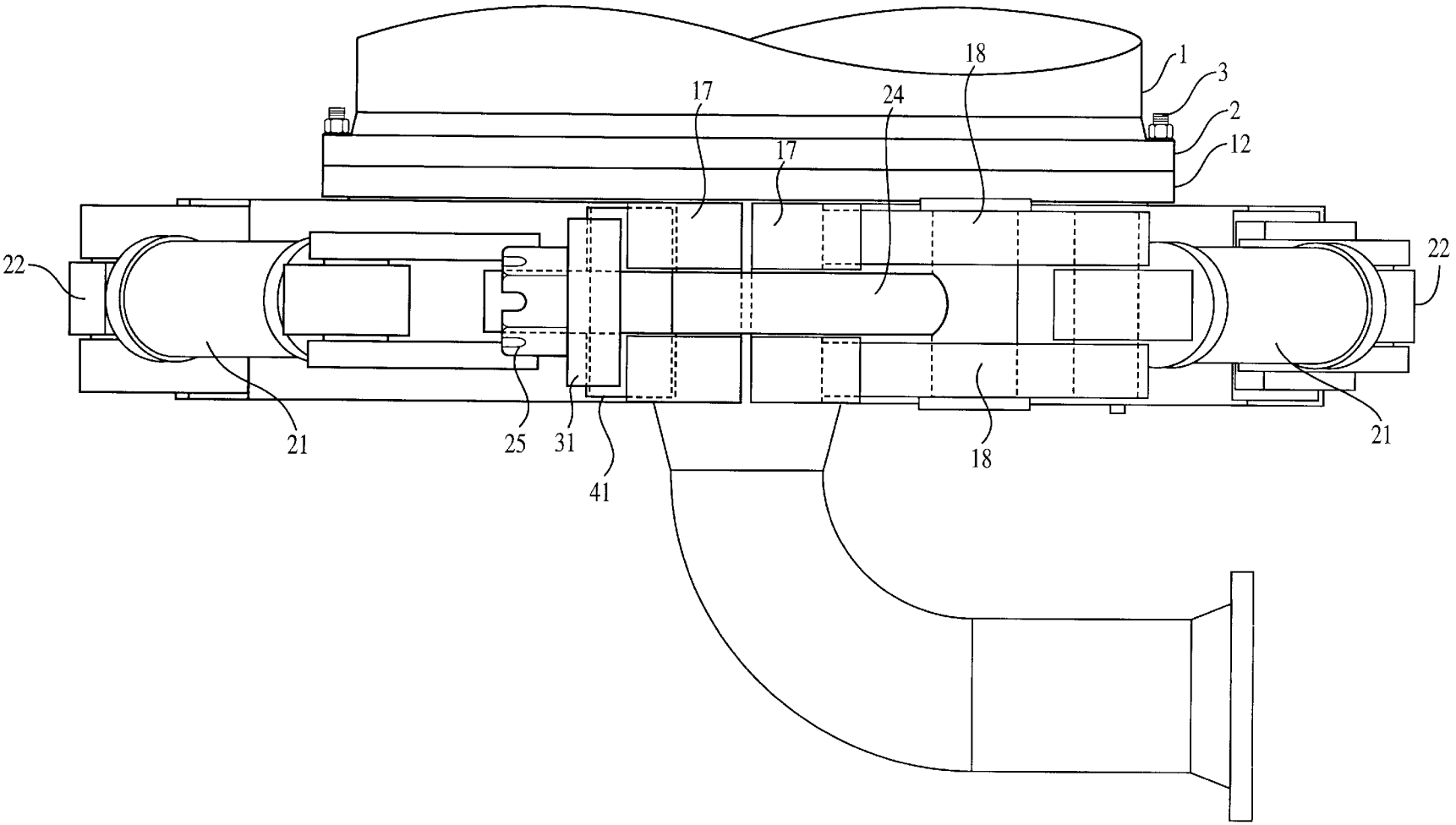
FIG. 3 is a side elevational view of an exemplary embodiment of a closure device of this invention.

FIG. 3 is an elevational view of the clamping device of the invention having components which will be described below. Preferably all the components are metal, such as types of steel.

Figure 4:
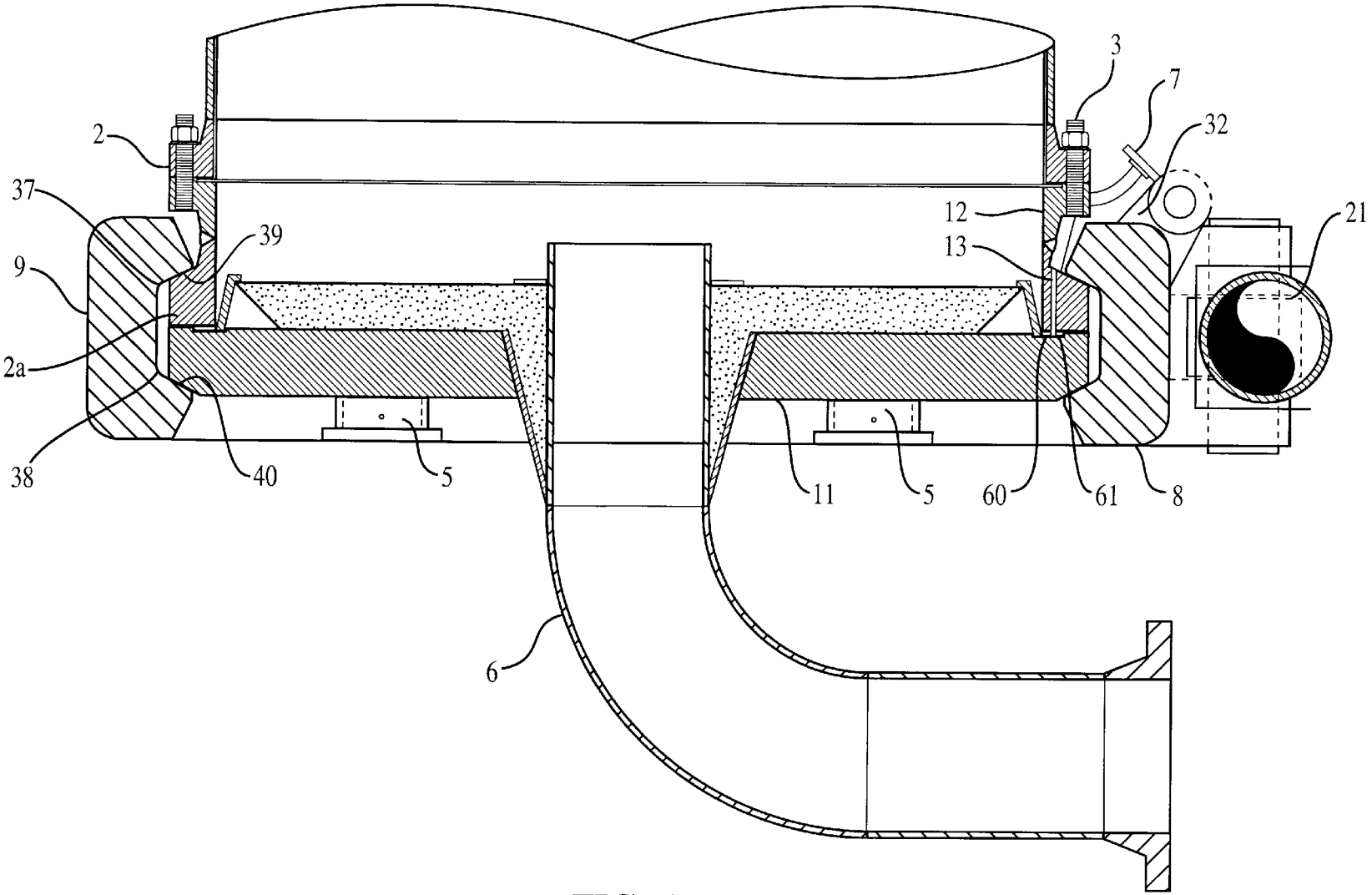
FIG. 4 shows the essential clamping parts of the device of FIG. 3 in cross-section, as it would be bolted onto a spool piece adaptor on the flange at the bottom of the drum, whether a new drum or retrofitted onto an existing drum, and shows a closure flange that is slightly different compared to the conventional manually-bolted closure flange, by virtue of the tapered outer edge of the flange instead of a square-cornered flange.

FIG. 4 shows how the new assembly spool piece 12 is bolted onto the existing stationary drum flange 2, instead of the closure flange 4 being directly bolted there; the same conventional studs and nuts 3 are used.

Figure 5B:
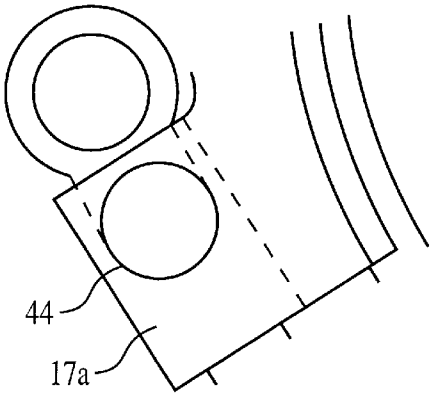
FIG. 5B is a detail view of an alternative design of a portion of the device of FIG. 5A.
Figure 5A:
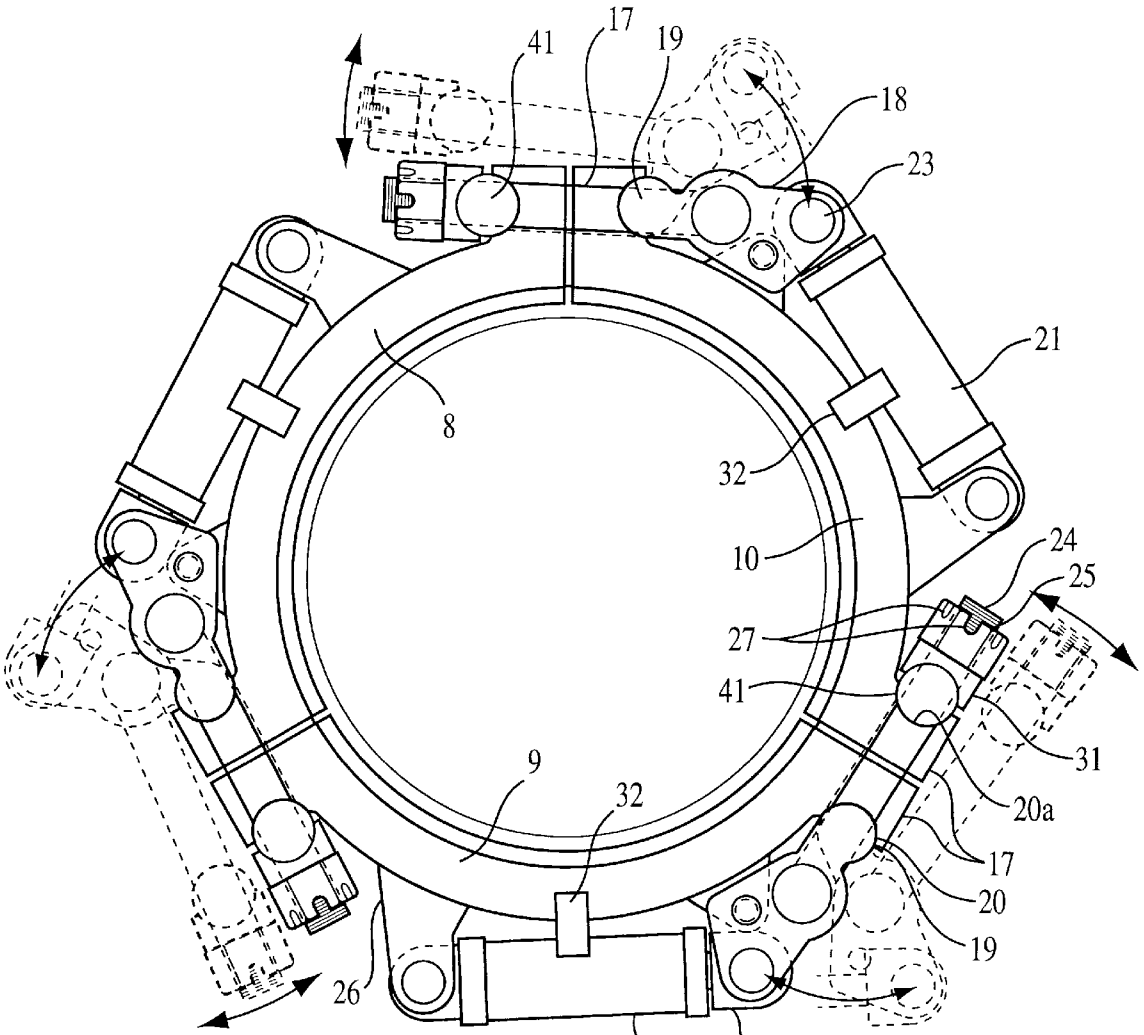
FIG. 5A is a bottom view of the closure device.
Figure 7A:
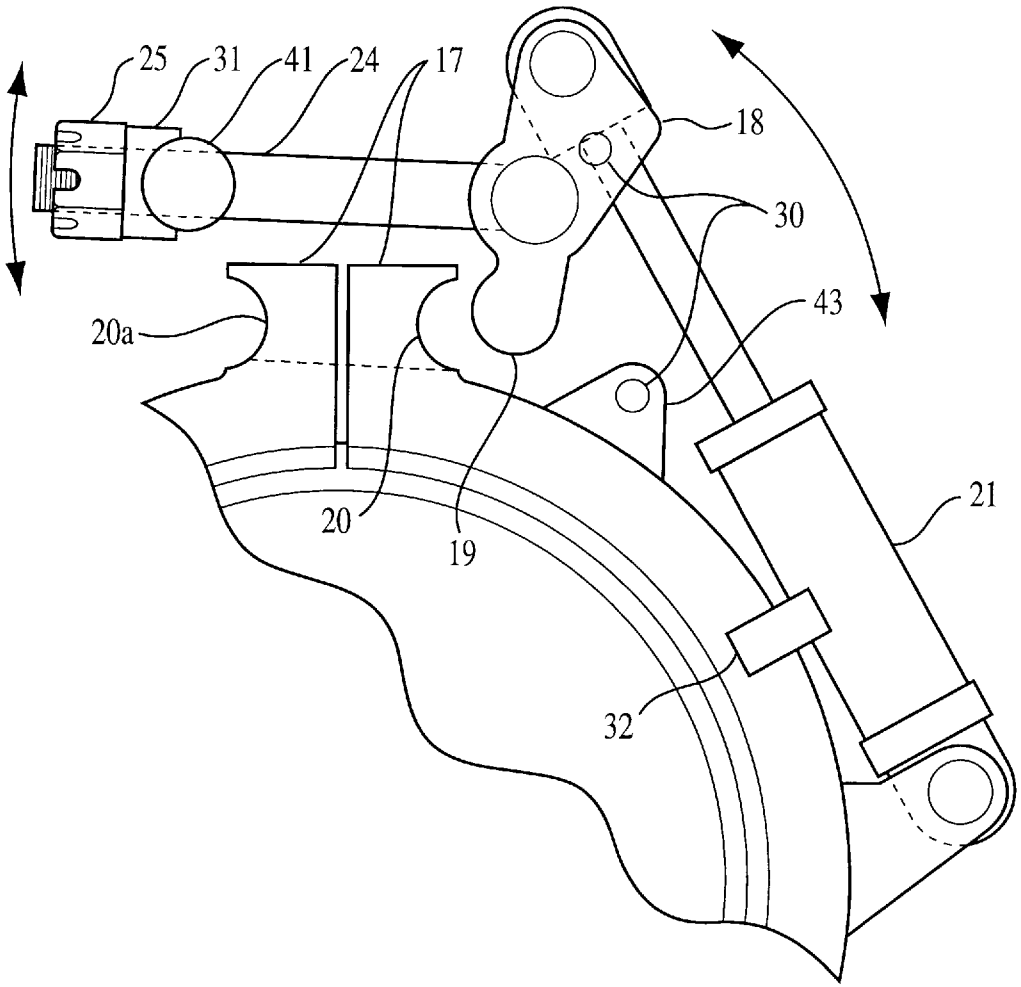
FIG. 7A is a top plan detail view which shows the essential parts of the clamping mechanism of FIGS. 3, 4 and 5A at placement of the clamping parts into position.

FIGS. 4, 5A and 7A show how automated clamping of closure flange 11 to stationary drum flange 2, via the adaptor or spool piece 12, is accomplished. A large circumferential force is applied to typically three or more (three are illustrated) substantially identical clamp ring sectors 8, 9 and 10 by three identical hydraulic cylinders 21, or other conventional actuators, preferably linear actuators, pulling on three identical toggle plates 18 through three identical pins 23. Those three clamp ring sectors are forced radially inwards on flange 2*a* of spool piece 12 and closure flange 11, by the circumferential force. The tapered inner surfaces 37 and 38 slide on matching tapered surfaces 39 and 40 of flanges 2 and 11. Thus they clamp flanges 2*a* and 11 together. The flange 11 also has a conduit 6 therein for passage of hydrocarbon fluids during the coke formation process.

The required radial force for clamping is calculated from the pressure force that is trying to separate the flanges 2*a*, 11, and from the angle of the tapered inner surfaces on the inside of the three sector rings 8–10, and from the coefficient of friction between the tapered surfaces 37–40. The cross sectional area of the three clamp ring sectors 8–10 is important to be able to develop and sustain the closure force required. The taper of the angles must be an angle greater than the angle whose tangent is equal to the coefficient of friction between the sliding surfaces, to prevent seizure of the sliding surfaces, or approximately 30° (e.g. between about 20°–40°), depending upon details of the materials used. Without that requirement included, the sector clamp rings might lock onto the tapered surfaces 39 and 40 of the flanges 2*a* and 11.

To develop the circumferential force needed for clamping, the cylinders 21 pull on toggle plates 18, forcing the male cylindrical ends 19 into matching female cylindrically machined recesses 20 at the protruding ends 17 of sector clamp rings 8, 9, and 10. This applies a pull on three identical tee bolts 24, which force transfers into threaded castellated nuts 25. The nuts 25 press onto half saddles 31, which press onto pins 41, which fit into the said cylindrically machined recesses 20 in ends 17 of the sector clamp rings. Adjustment for wear is by castellated nuts 25 on tee bolts 24, which adjustments are held in place by cotter pins through tee bolts 24 and into castellated slots 27 in the nuts. All sliding surfaces, namely the tapered surfaces 37, 38, 39 and 40, the cylindrical surfaces 20 and 20*a*, and the pins 41 and 23, are preferably hard surfaced to prevent wear and to reduce the coefficient of friction.

FIG. 5B shows an alternative arrangement for hinging the toggle plates 18 at one end, instead of the cylindrically machined end 19 of plates 18. Herein, a hinge pin 44 is fastened to the end 17*a* of the sector clamp ring 8 and there is only rotation of toggle plates 18 about hinge pin 44, without any other articulation.

If different powered actuators than the linear actuators 21 are utilized, the configuration of components 18, 24, etc., or the specific force transferring components utilized, may change.

Figure 6A:
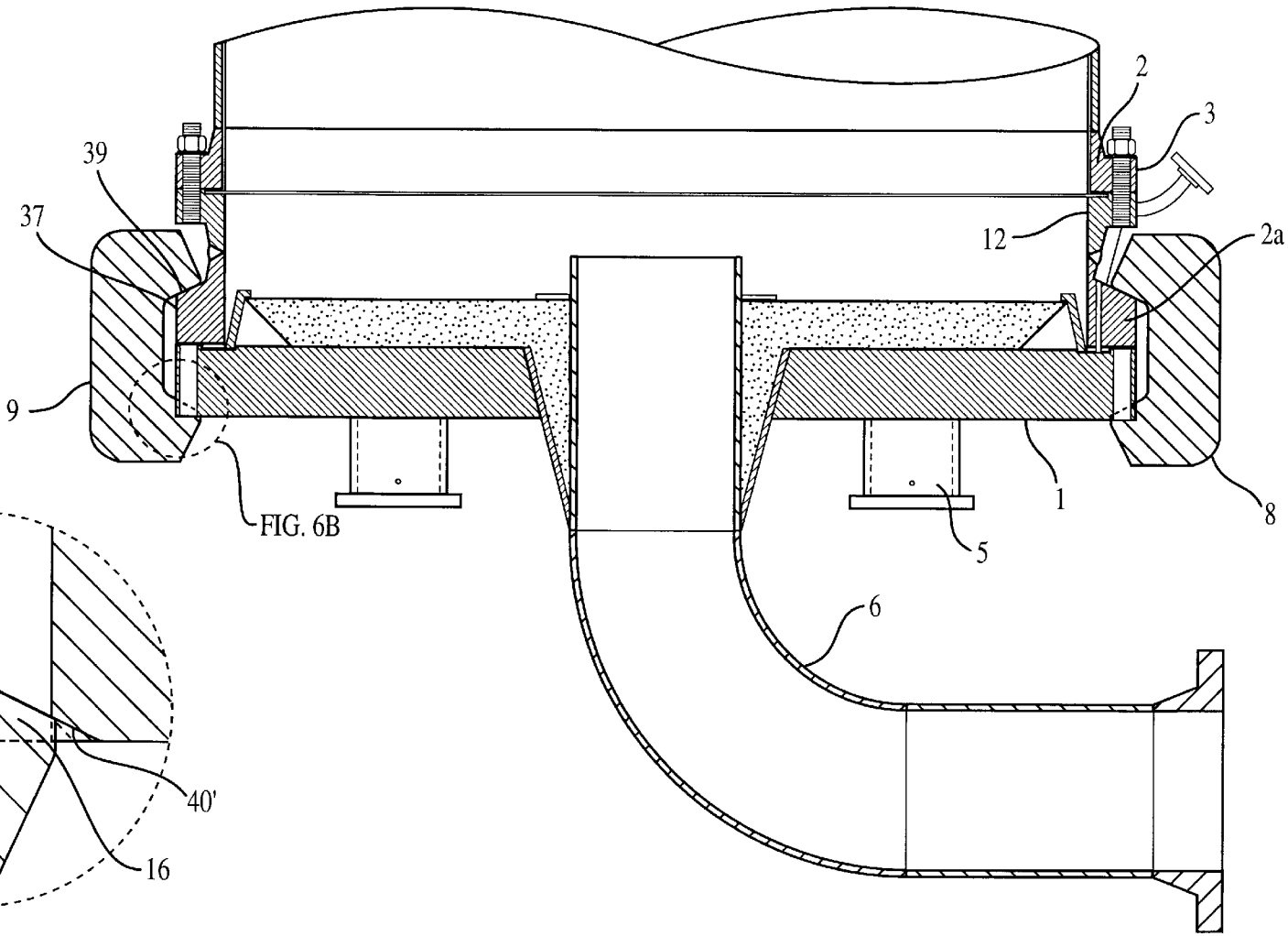
FIGS. 6A and 6B are side and detail cross sectional views of a device according to the invention which show how an existing square-cornered closure flange would be machined into a tapered outer edge flange by cutting off the area at the outer lower corner, in accordance with the invention.

FIG. 6A shows how the objective of retrofitting manually headed drums can easily be achieved. First, adapter spool piece 12 is bolted where closure flange 4 used to be bolted, using the same conventional studs and nuts 3. The existing closure flange 4 can be discarded, or it can be converted to the required new style closure flange 11 with taper, by simply machining a taper 16 into the lower outer corner of the square-edged flange 4.

Figure 8:
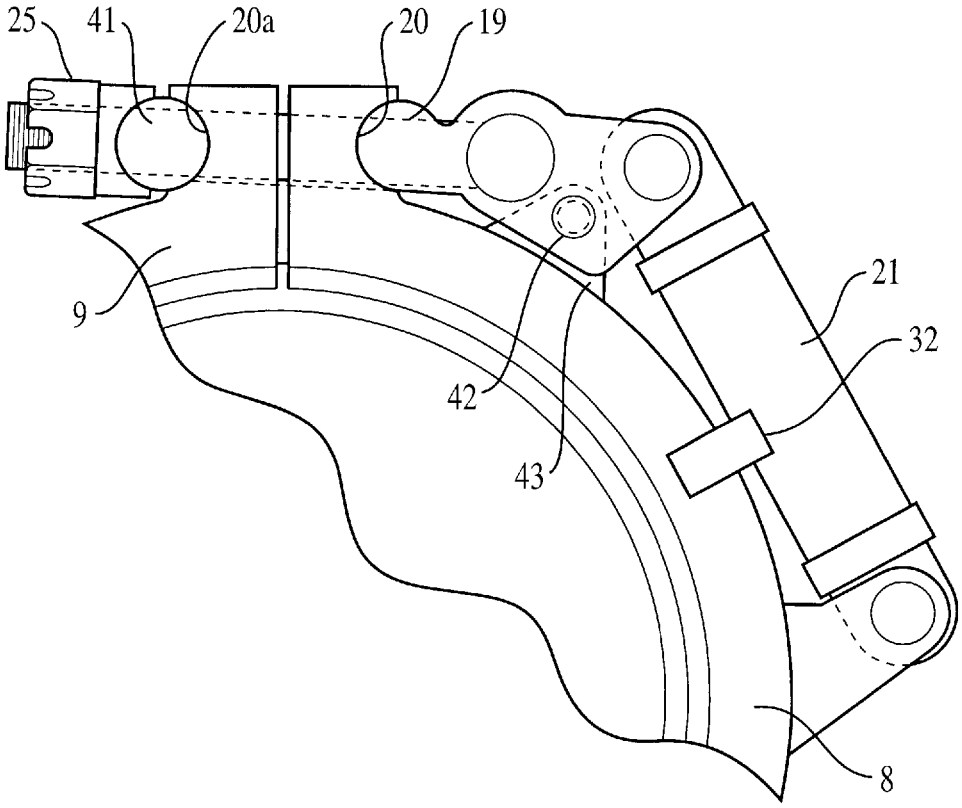
FIG. 8 is a top plan detail view like that of FIG. 7A which shows the same parts of FIG. 7A after the clamping has been effected.

FIG. 7A shows, for one embodiment, clearly how the clamping parts of toggle plates 18, tee bolt 24, and pin 41 are swung into the clamping position of FIG. 8, bringing cylindrical ends 19 of the toggle plates 18 inwardly and into female cylindrical surface 20. Tee bolt 24 with nut 25 and saddle 31 are passed by the end of the sector clamp ring 17 and into its mating surface 20*a* (e.g. a relatively loose fit may be provided to facilitate removal). When the toggle plates 18 are in clamped position of FIG. 8, a strong, e.g. hard metal, easily removed jamming pin 42 is inserted into each set of the aligned holes 30 in the toggle plates 18 and clamp plates 43. Each pin 42 prevents its associated cylinder 21 from extending and releasing the clamping force.

FIG. 5B provides an alternative detail to the manner of clamping described here in FIGS. 7A and 8, insofar as the hinging of one end of toggle plates 18 is concerned, and that detail can be substituted for cylindrical ends (first locking surfaces) 19 of the toggle plates and mating second locking surfaces 20 of ends 17.

Figure 7B:
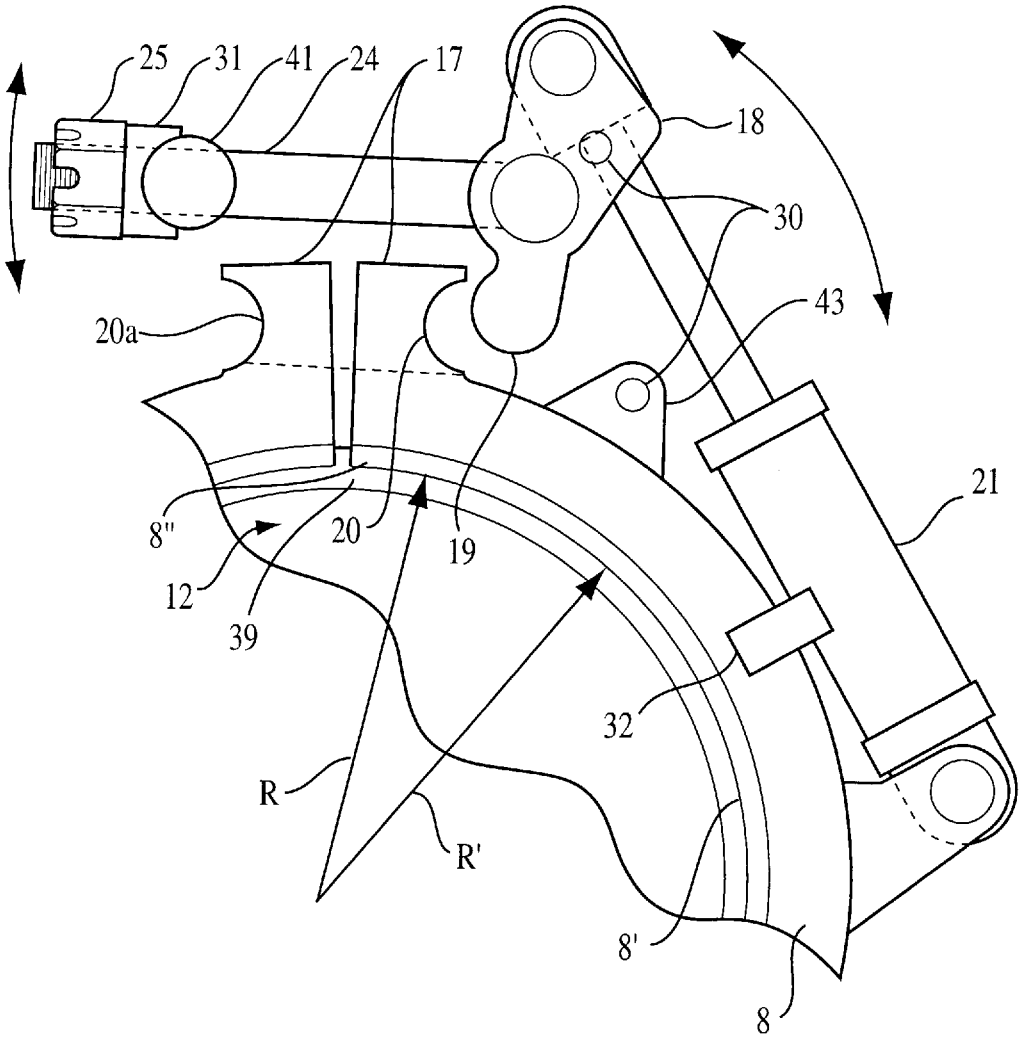
FIG. 7B is a view like that of FIG. 7A only showing an embodiment of the clamping mechanism with a modified clamping surface.

In the FIG. 7B embodiment, a novel solution is included for the problem in large sizes of clamped tapered flanges, of insufficient clamp force being applied at center portion 8' compared to the clamp force applied at the ends 8", which has prevented use of these clamp rings in the larger sizes. The curvature of the clamp ring sector (8–10) does not match the curvature of the flange 11 and spool piece 12. That is the effective radius of the clamp ring sectors 8–10 is slightly larger than the effective radius of the flange 11 and spool piece 12. FIG. 7B shows the effective radius R of the flange 11 and spool piece 12, and an exemplary radius R' of the clamp ring sector 8. The radius R' is preferably about 2–13% larger, most preferably about 5–10% larger (e. g. about 1.1 R) than the radius R. This difference is such so as to cause only a center portion 8' (not the end portions, e. g. 8"—see FIG. 7B) of the clamp ring sector 8 tapered annular sector 37, 38 to contact said first and second tapered annular clamping surfaces 39, 40, and to cause the clamp ring sector 8 to bend to cause the end portions 8" thereof to come into contact with said first and second tapered annular clamping surfaces 39, 40 when the clamp components 19, 21, 41, 20, 20*a* are in the position illustrated in FIG. 8 [with the male and female cooperating locking surfaces 19, 41, 20, 20*a* in locking engagement with each other], and thereby provide the desired effective clamping force at the center portion. The same situation exists for the clamp ring sectors 9, 10. The exact degree of mismatch of the radii R, R' (within the 2–13%, or 5–10% ranges) will depend upon the final design bending strength of the clamp ring sectors 8–10.

Figure 9:
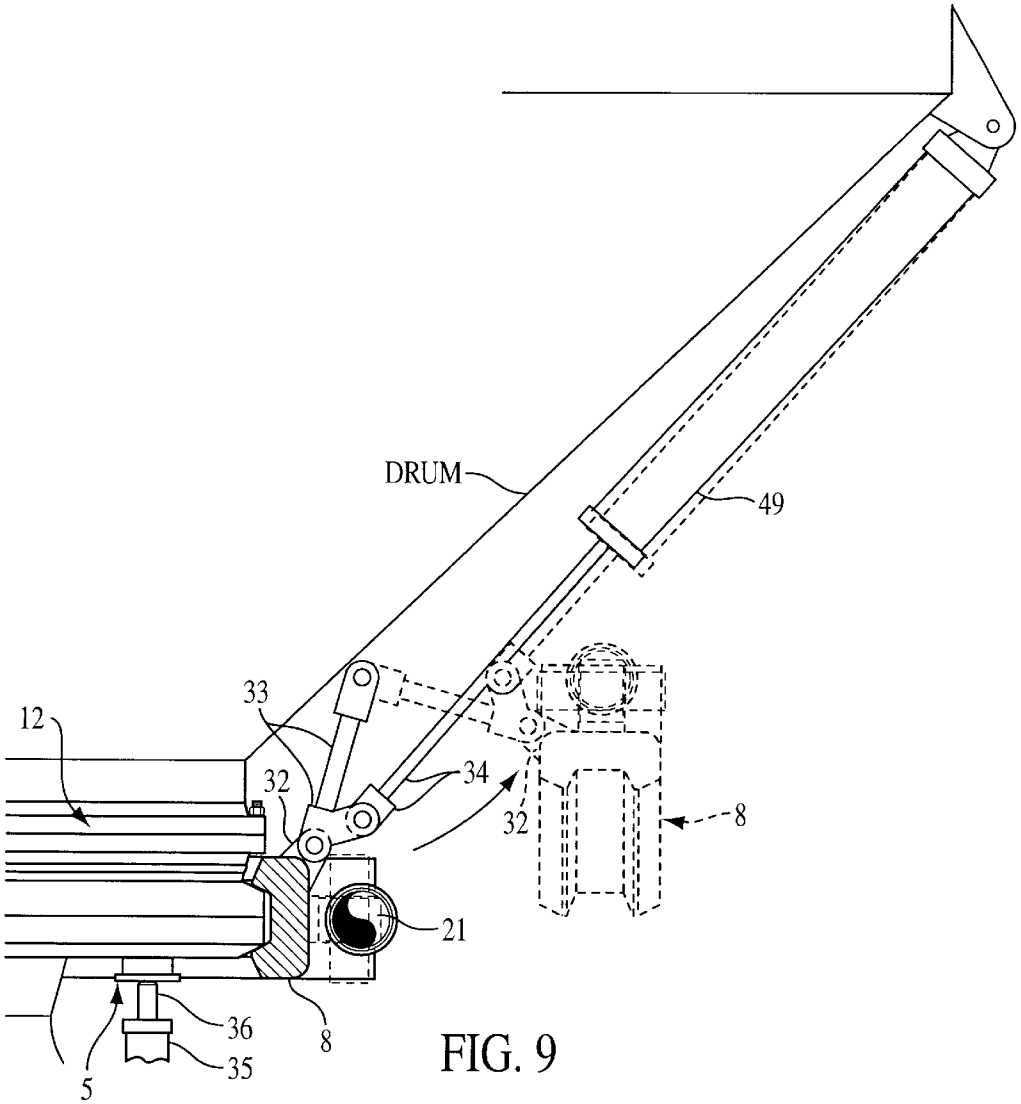
FIG. 9 is a side detail, partly cross-sectional and partly elevational, view showing an exemplary means for moving the clamping parts out of the way after unclamping, out of the way, sideways and upwards, while the piston rods of four hydraulic cylinders press upwards on support pads that are part of the closure flange, holding the closure flange up against the drum flange.

FIG. 9 shows a detail associated with the total function of the unheading of a drum, and is not an essential part of the automated clamping of this invention, but rather only are examples of a powered mechanism that might be utilized therewith. Shown in FIG. 9 is one method of moving the sector clamp rings 8, 9, and 10 and their associated hydraulic cylinders 21 sideways and clear of the coke that will be falling out the six foot flange 2 opening. A pneumatic or hydraulic cylinder 49, or like linear actuator, pulls through a rod and clevis 34 on a pivoting rod and clevis 33, which lifts each sector clamp ring (e.g. ring 8 in FIG. 9) outwards and upwards, into the dotted line position. Whenever the closure flange 11 is to be raised or lowered or supported in place, the preexisting, conventional four hydraulic or pneumatic cylinders 35, or like supports, have their rods 36 extended, which push on four support plates that are fastened to the underside of closure flange 11. Once the closure flange 11 is removed, the drum cleaning procedure is practiced as in the prior art.

Figure 10A:
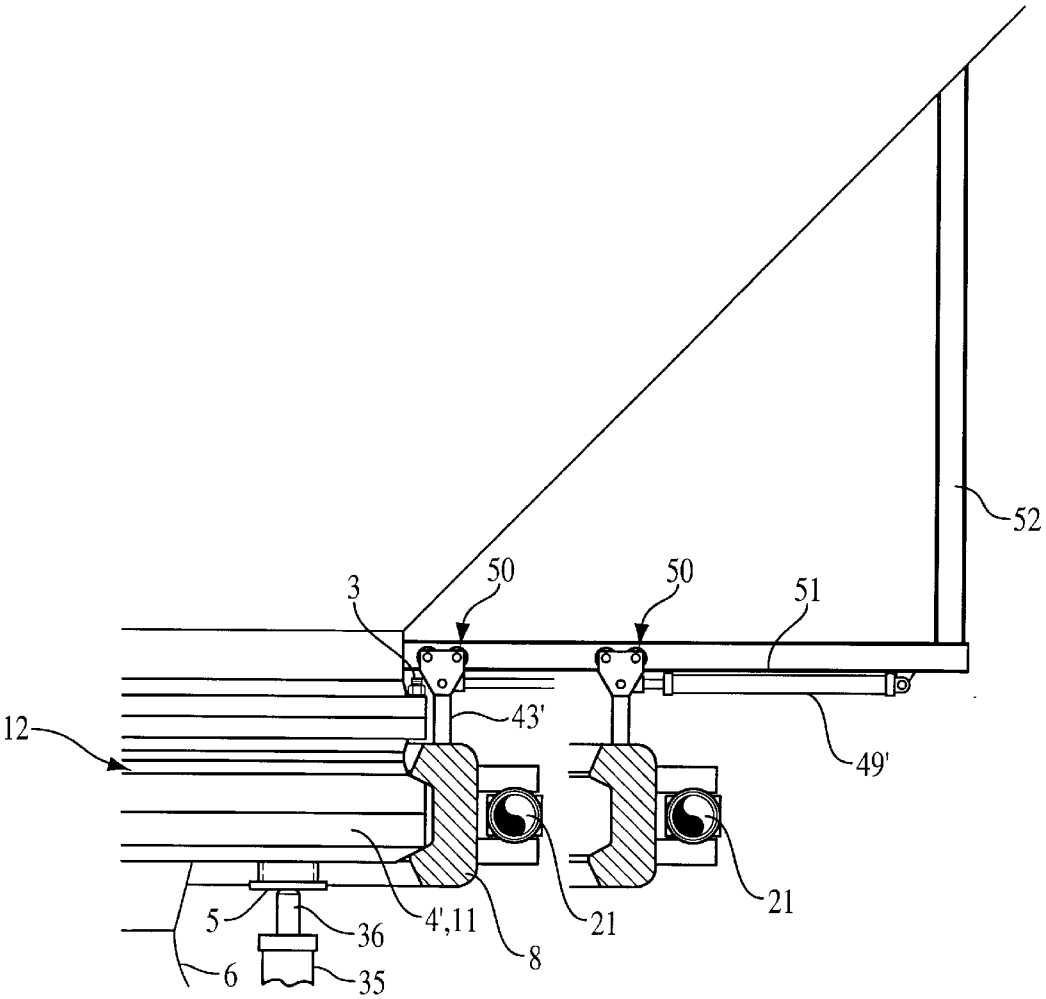
FIGS. 10A and 10B are views like that of FIG. 9 for two other embodiments of exemplary means for moving the clamping parts out of the way after unclamping.

In the embodiment of FIG. 10A actuators 49' are provided for moving the clamp ring sectors 8–10 completely sideways, rather than also pivoting, as in the FIG. 9 embodiment. The ring sectors, such as the sector 8 illustrated in FIG. 10A, are connected by supporting flanges 43' to a roller assembly 50 mounted on a substantially horizontal track 51. The track 51 is connected to and supported by a stationary support, such as being connected via vertical beam 52 to the drum (e. g. the bottom conically tapered portion thereof) itself, as seen in FIG. 10A. The right hand representation of the sector 8 shows its position after the actuator 49' (which preferably is a linear actuator, such as a hydraulic piston and cylinder) is operated to unclamp the bottom flange 4', 11.

Figure 10B:
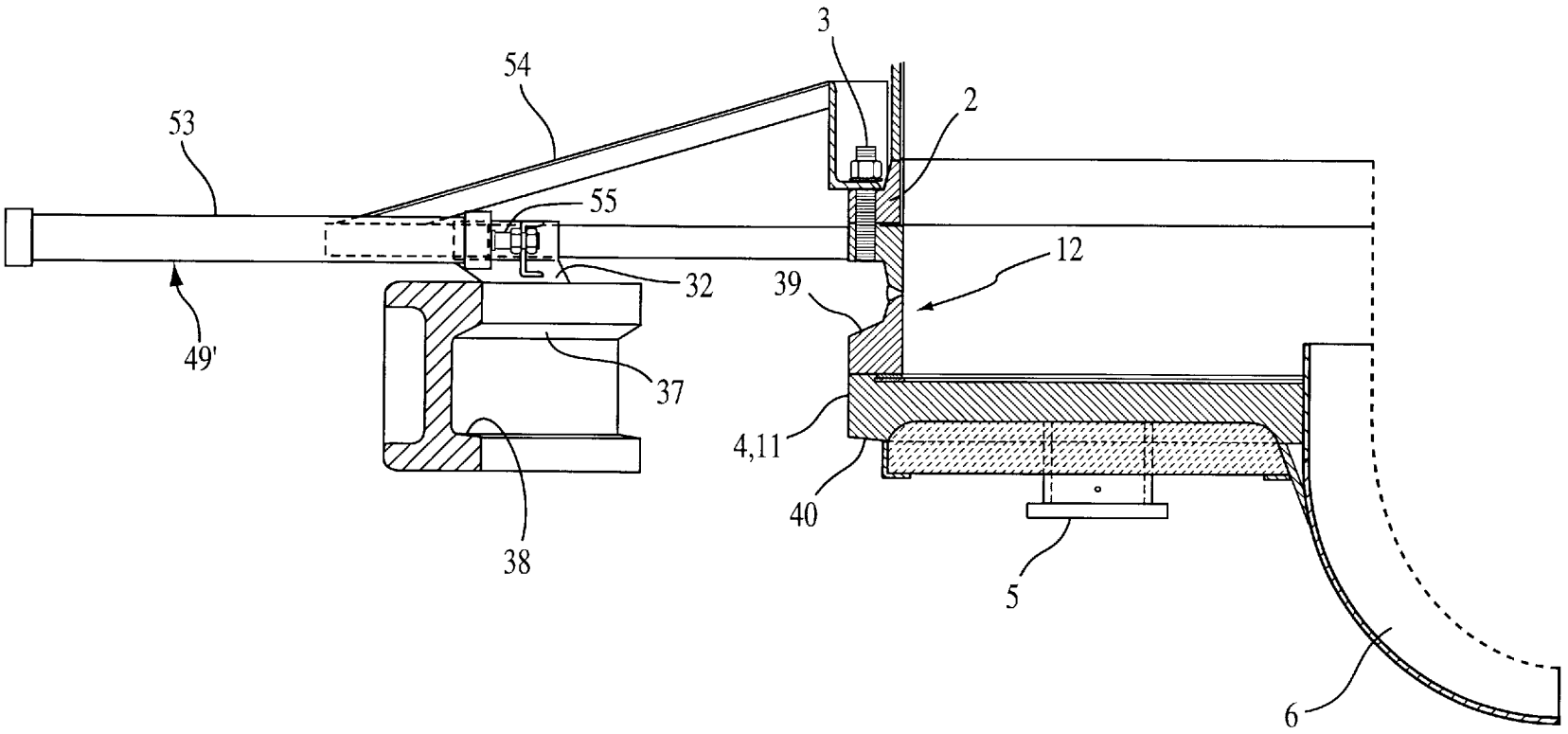

FIG. 10B shows an embodiment like that of FIG. 10A only the reciprocating mechanism is simpler. In this case the actual cylinder housing 53 of the hydraulic cylinder 49' is mounted by an angled beam 54 (connected just above flange 2 by the bolts 3), and the piston rod 55 of hydraulic cylinder 49' is connected to the supporting flange 32 of the sector 8. By extending the rod 55 the clamping surfaces 37, 38 of the sector 8 are moved into clamping contact with the surfaces 39, 40.

Figure 11:
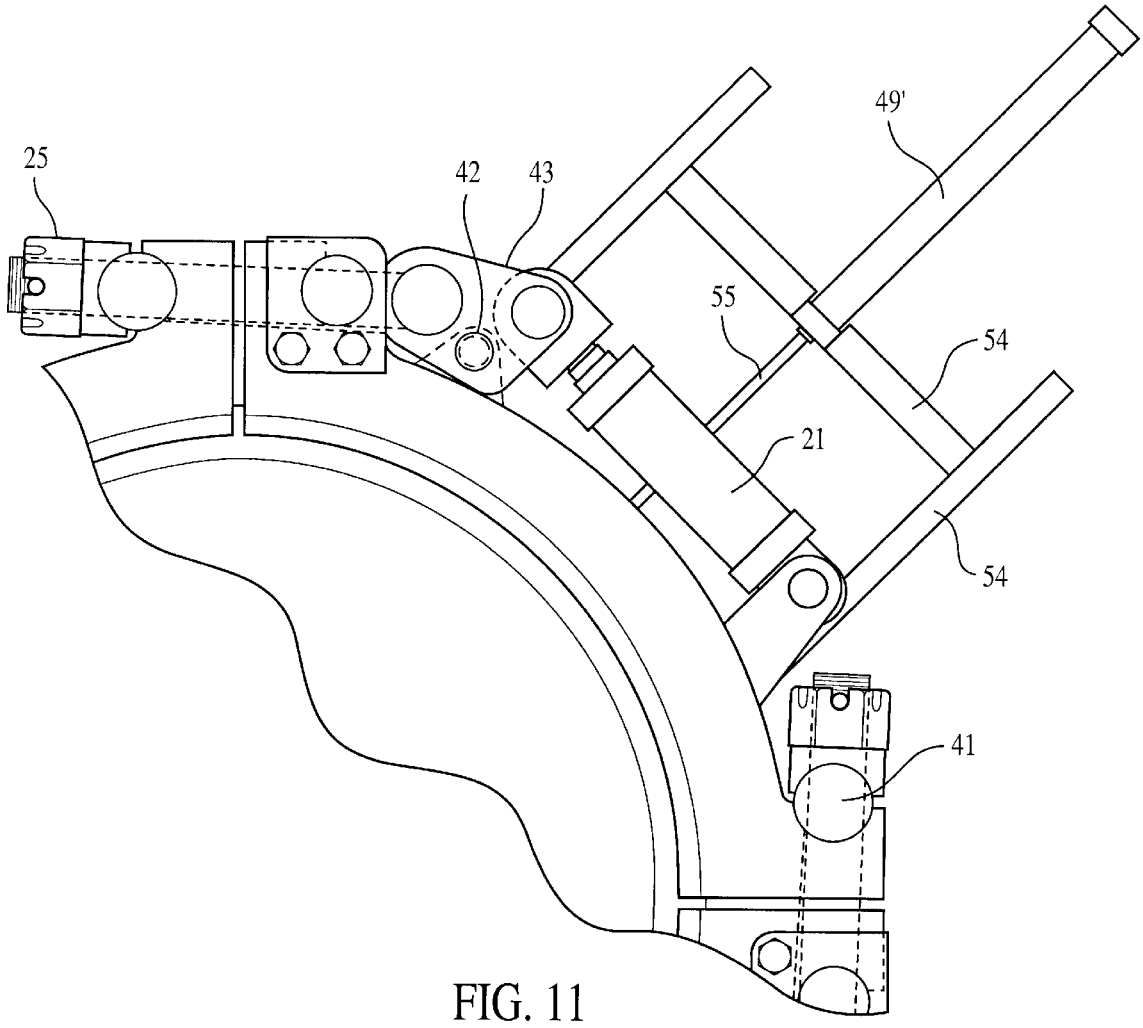
FIG. 11 is a view like that of FIG. 8 only for an embodiment where four clamp rings and associated actuators are employed, and the actuators for moving the clamp ring sectors are those of the FIG. 10B embodiment.
Figure 12:
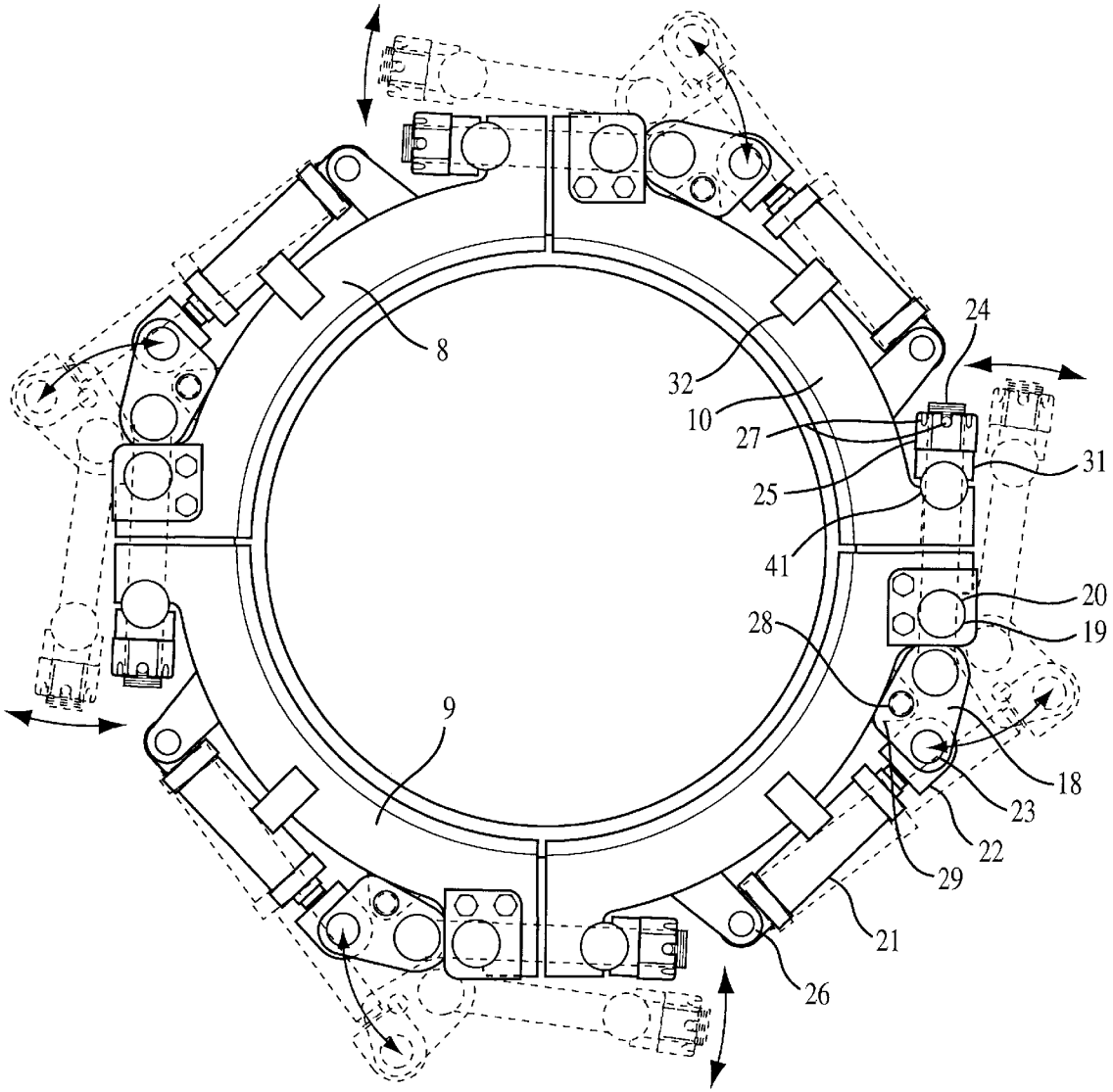
FIG. 12 is a view like that of FIG. 5A only for the embodiment of FIG. 11.

In the FIGS. 11 and 12 embodiment, an assembly like that illustrated in FIGS. 3, 7A, 7B, and 8 is illustrated only showing four clamp ring sectors (like the sectors 8–10) instead of three. While the more clamp sectors there are the easier it is to obtain a uniform squeeze of the clamps around the entire circumference of the flanges, each added sector (and associated actuator 21, clamp surfaces 19, 41, etc.) adds significant extra expense. Therefore even for assemblies according to the invention, where the diameter of the flange 4', 11 being clamped, is over 40 inches (typically over 60 inches, e. g. about 72 inches), typically three or four ring sector clamps (e. g. elements 8–10) is ideal. To enhance the efficiency of each clamp, the differential diameter feature of FIG. 7B is preferably employed.

Figure 13A:
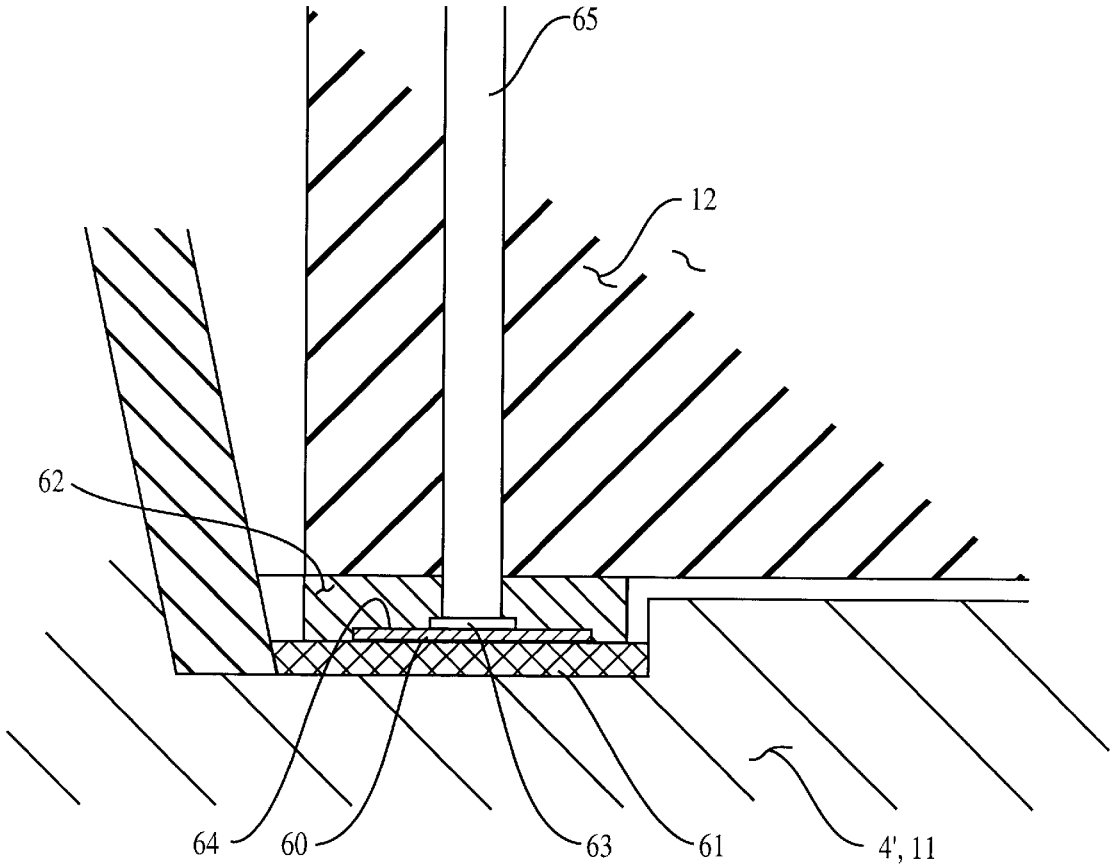
FIG. 13A is a detail cross-sectional view showing a preferred embodiment for a gasket assembly for sealing the bottom removable flange to the spool piece for all of the embodiments according to the invention.

FIG. 13A illustrates a gasket feature that may be very desirable according to the invention in ensuring a seal between the spool piece 12 and a bottom flange 4', 11, according to the invention. A significant problem in sealing large flanges as according to the invention (i. e. 40 inches or more in diameter, e. g. about 72 inches) comes from the required gasket squeeze. The metal gasket 60 (also seen—illustrated for general location only—in FIG. 4) is typically ¾–1 inch wide, and may need 4000 psi of squeeze to seal reliably between the hard-surfaced rings 61, 62, provided on the flange 4', 11 and the spool 12, respectively. For a one inch wide gasket 60 the squeeze force is thus about 1,000, 000 pounds (4000×1 inch width×72 inch diameter×π). Thus if the gasket 60 width could be reduced, the sealing force could be too. However, a narrower gasket 60 would be too weak to handle.

The above-described conflict is resolved according to the invention of FIG. 13A by machining a relief groove 63 in the gasket groove 64 in ring 62 so that the same strong gasket 60 can be used, but the unit pressure increases due to the reduction of area by the relief. To make the gasket 60 leak proof (leaks are serious because the hydrocarbon fluid of the coke manufacturing process is far above the flashpoint temperature, and any leak results in a fire), steam is fed to the relief groove 63 from an external source through the passage 65. The steam pressure is slightly higher than the process pressure in the drum, thus any gasket 60 leak is steam into the drum, or steam out from the drum, both tolerable leaks.

Figure 13B:
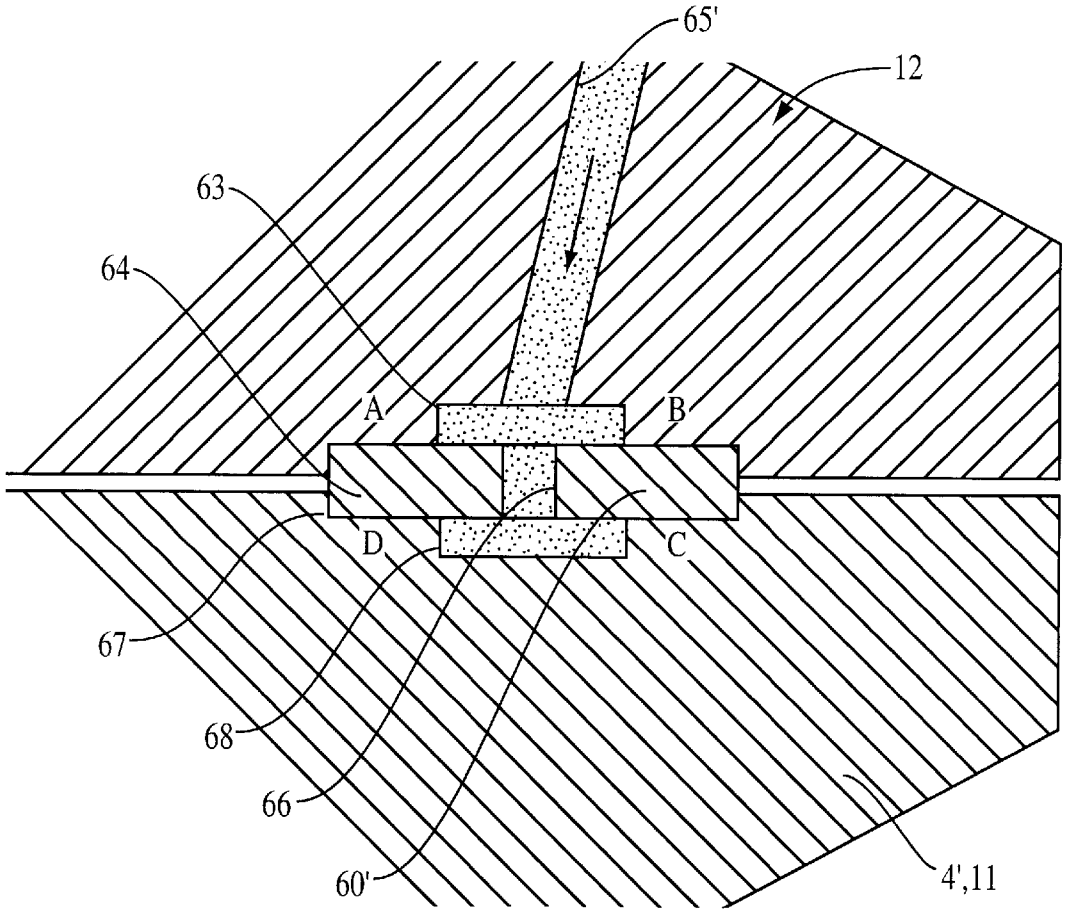
FIG. 13B is a view like that of FIG. 13A of another embodiment.

FIG. 13B shows an assembly that is a modification of that of FIG. 13A. In FIG. 13B components the same as those in FIG. 13A are shown by the same reference numeral, and components comparable but not the same are shown by the same reference numeral followed by a prime“’”.

In the FIG. 13B embodiment, the thin metal annular flat (non-ribbed) gasket 60' has a plurality of spaced through-extending holes 66 therein. Gasket grooves 64, 67 are provided in both clamped components 12, and 4',11, as are relief grooves 63, 68, although only one of the grooves 64, 67 need be provided (in which case the gasket 60' is flush with the surface of the grooved component, as in FIG. 13A). Steamfrom steam passage 65' flows into the relief groove 63, through the holes 66 in gasket 60', and into relief groove 68. The surfaces labeled A, B, C and D apply a harder squeeze to the gasket 60' than if relief grooves 63, 68 were not provided, which harder squeeze is highly desirable. As in the FIG. 13A embodiment, the use of steam in passage 65' at a steam pressure that is slightly higher than the process pressure in the drum ensures that any fluid leaking past the gasket 60' is steam into the drum, or steam out from the drum, both tolerable leaks.

The assembly of FIGS. 13B has broader applicability than just to a coke drum. That assembly may be used for providing substantially leak-proof sealing of any volume. The assembly comprises:

The volume (the inside of the coke drum) having fluent material (e.g. solids in fluid, or just fluid, gas or liquid) at a first pressure. First and second substantially annular flanges (4', 11 and 12) having face-to-face engagement along first and second surfaces thereof (the parting line as seen in FIG. 13B), the surfaces abutting the inner volume at a first end portion (the left side thereof in FIG. 13B), and abutting an exterior volume at a second end portion (the right side thereof in FIG. 13B). First and second main substantially annular grooves 64, 67 formed in the first and second surfaces, respectively. A relief groove 63, 68 formed in each of the main grooves 64, 67. An annular metal gasket 60' disposed in the main grooves 64, 67, the gasket 60' having a plurality of through extending openings 66 therein extending from one relief groove 63 to the other 68. And a passage 65' extending through one of the flanges (12) and connected to a source of steam at a second pressure, higher than the first pressure, so that steam is supplied to the relief grooves 63, 68, and if there is leakage between the first and second surfaces it is of steam either into the interior volume (e. g. the coke drum), or to the exterior of the whole assembly (to the far right as seen in FIG. 13B).

Figure 14:
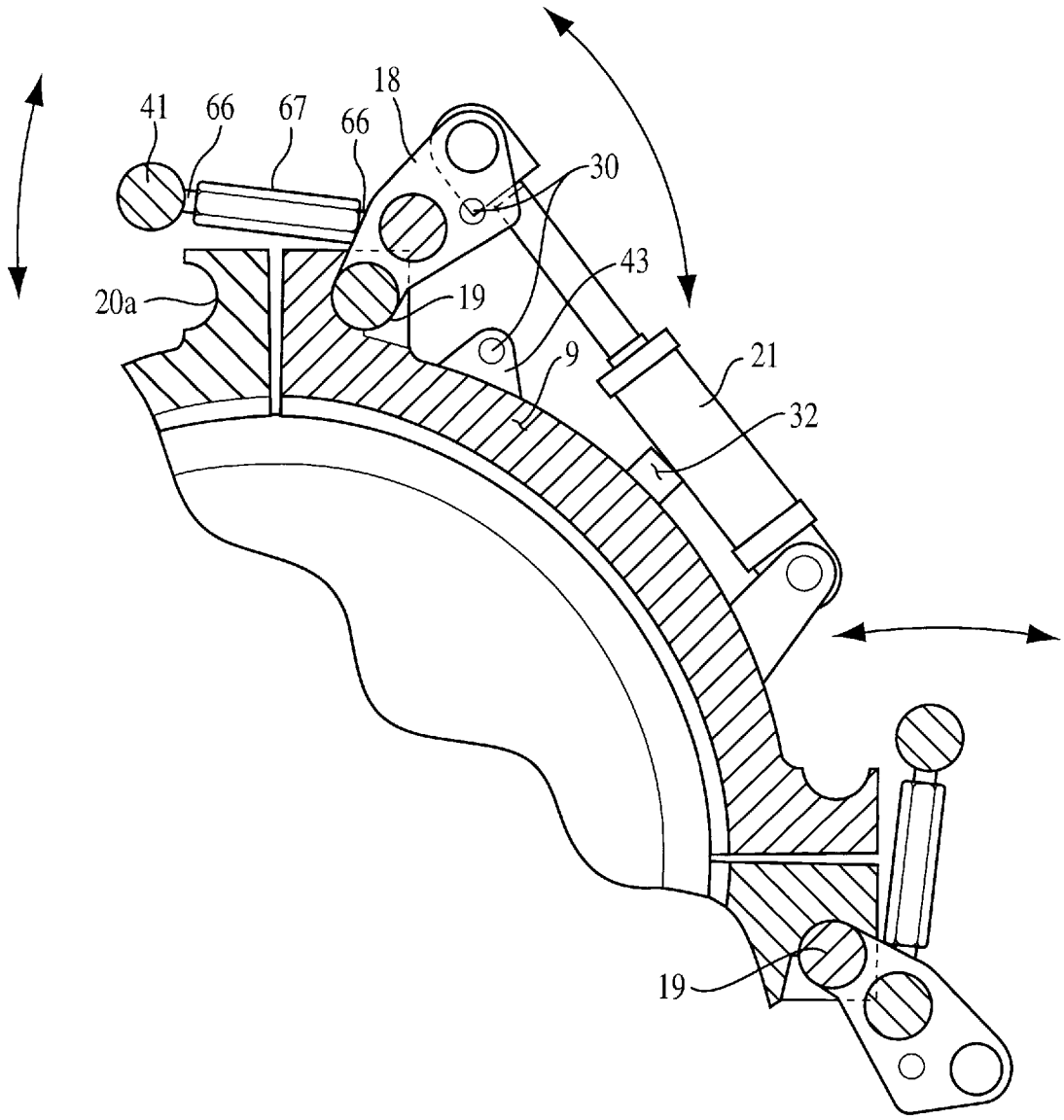
FIGS. 14 and 15 are views like those of FIGS. 7A and 8 only illustrating an embodiment in which the configuration of the locking components is different.
Figure 15:
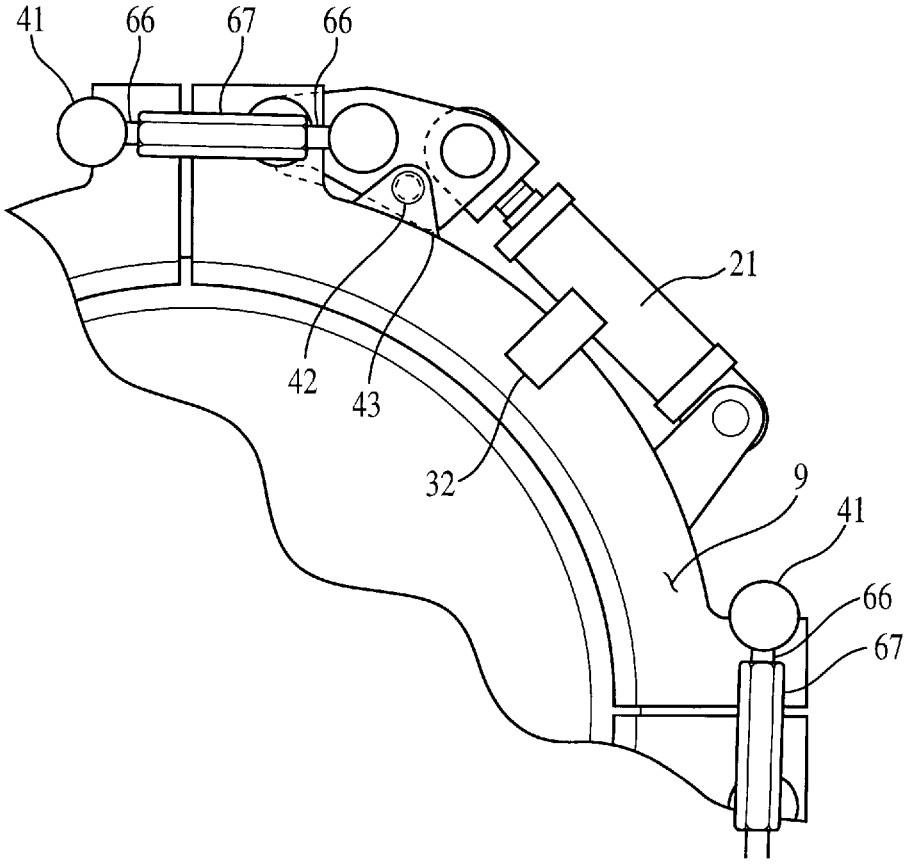

FIGS. 14 and 15 show an alternative toggle clamp assembly, using a pair of outside bolts 69 connected by internally threaded tube 73 instead of the tee-head bolt 24 of the FIG. 7A embodiment. The bolts 69, with male end surfaces 19, 41 ultimately connected thereto, straddle the ends of the clamp ring sectors 8–10. This construction is less expensive than the one with the bolt 24 since the bolts 69 may be less expensive since each had one half the stress area of the large area single tee-head bolt 24.

Figure 16:
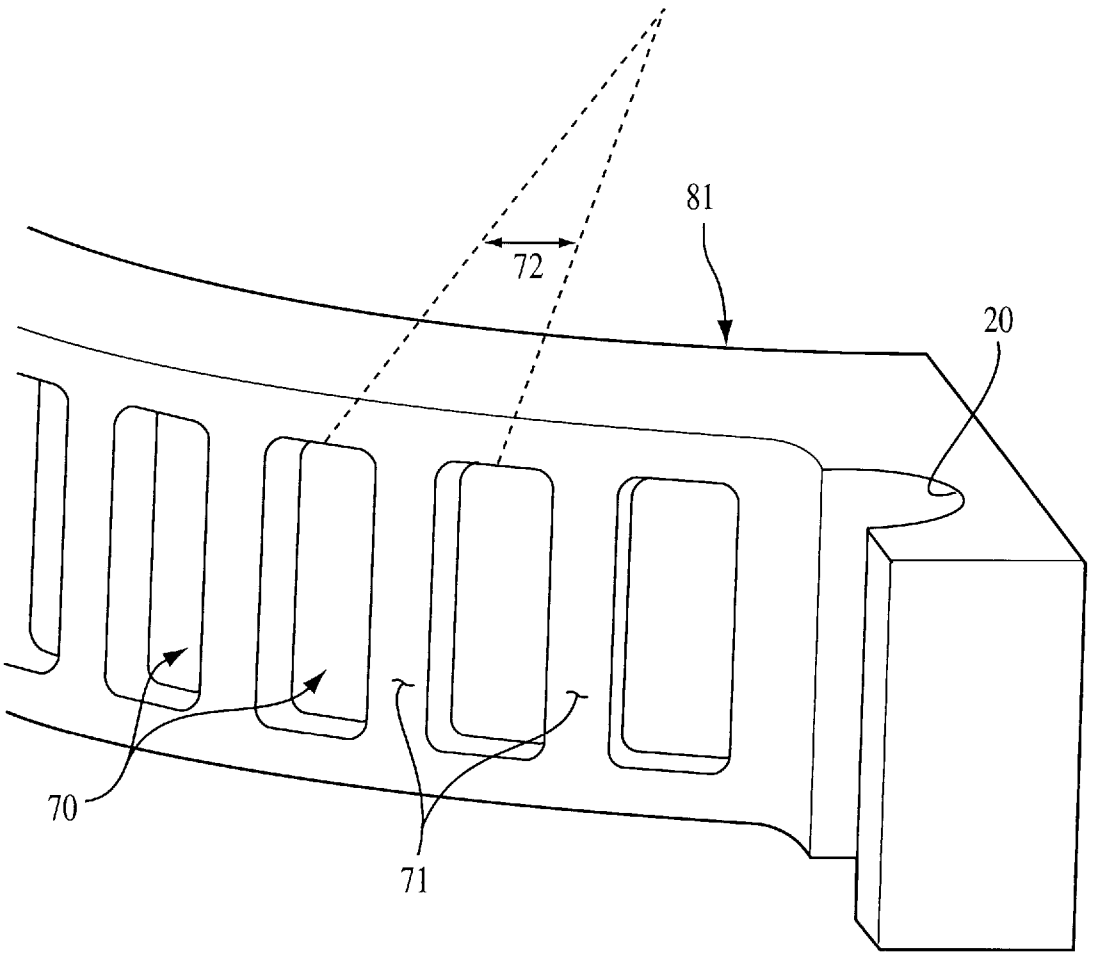
FIG. 16 is a top perspective partial view of an alternative embodiment of a clamp ring sector according to the present invention.
Figure 17:
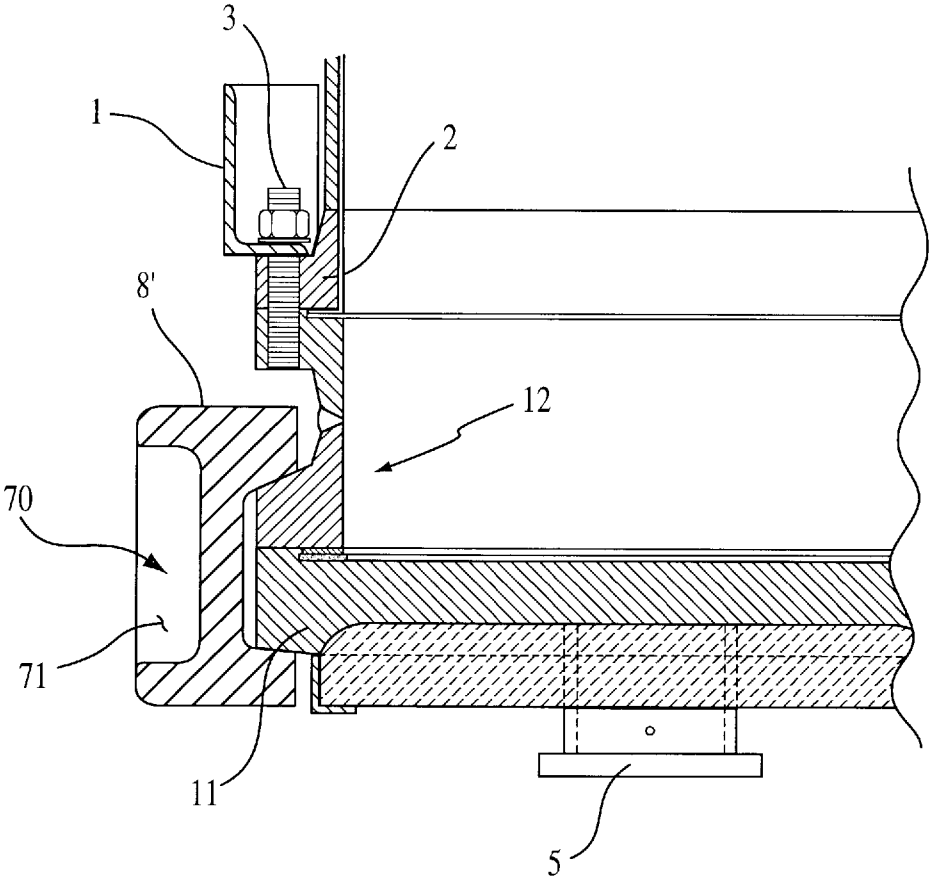
FIG. 17 is a detail side cross-sectional view showing a clamp ring sector like that of FIG. 16 in use in an assembly according to the invention.

FIGS. 16 and 17 illustrates an exemplary metal clamp sector 8 that is cast, with hollowed out—see 70—sections, with strong webs 71 between the hollowed out sections 70. The surfaces of the sections 70 may be disposed at an angle 72 (see FIG. 16) of about 3–7 degrees (e. g. about 5 degrees) with respect to a common center.

Figure 6B:
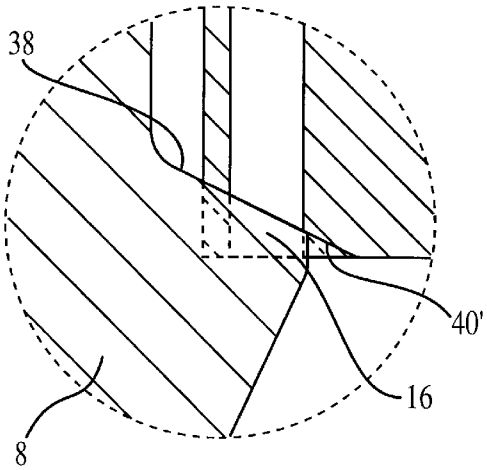

The invention also relates to a method of modifying an existing substantially vertical coke drum to semi-automate heading and unheading, so as to allow practice of the coke removal operation, as described with respect to the prior art. The method comprises the steps of: (a) Detaching the existing bottom removable flange 4, having a hydrocarbon fluid conduit 6 therein, from the existing coke drum bottom stationary flange 2. (b) Forming a generally downwardly facing annular tapered clamping surface 40' (see FIGS. 6A & 6B) on the bottom removable flange, to produce a revised removable flange 4' (having a hydrocarbon fluid conduit 6 therein), such as by using a torch and then grinding, and/or by machining. (c) Attaching the spool piece 12 to the drum stationary flange 2, e. g. using the already existing bolts 3, and associated nuts, as seen in FIG. 6A (although welding, or other suitable techniques may be practiced). (d) Attaching the plurality of second actuators 49, 49' to the drum in any suitable way (e. g. as illustrated in FIGS. 9, 10A, or 10B). (e) Moving the revised movable flange 4' into sealing engagement with flange 29 of the spool piece 12. (f) Using the second powered actuators 49, 49', moving the tapered clamping surfaces 37, 38 of the clamp ring sectors 8–10 into contact with the tapered clamping surfaces 39, 40' of the spool piece 12 and the revised removable flange 4' (e. g. see the solid line configuration in FIG. 9 and FIG. 6A); and (g) using the first powered actuators 21, moving the first locking surfaces 19, 41 into locking engagement with the second locking surfaces 20, 20*a* (see FIGS. 5A and 8), with the jamming pins 42 then put in place (FIG. 8) by passage through the openings 30 in the link 18 and flange 43 (see FIG. 7A).

Alternatively, instead of making the old flange 4 into the revised flange 4', step (b) may be practiced by discarding the old flange 4, and using a new flange 11 (having a hydrocarbon fluid conduit 6 therein) in its place. In completely new installations, there is no preexisting old flange 4, therefore the new flange 11 is used from the start, and the spool piece 12 may be integral with the drum, or retained as a separate spool from flange 2, to facilitate service or replacement with a spare assembly.

The method may also comprise the further steps of (h) unheading the drum by first moving the first powered actuators 21 to move the first and second cooperating male and female locking surfaces 19, 41, 20, 20*a* out of locking engagement with each other, and then (i) using the second powered actuators 49, 49', moving the ring clamp sectors 8–10 away from the drum while the revised or new bottom flange 4', 11 is supported by an external support (structures 35 36 engaging supports 5, as see in FIG. 9, for example), so that the bottom flange 4', 11 is free to move away from the drum upon movement of the external support (35, 36); (j) moving the bottom flange 4', 11 away from the drum (by moving the support structures 35, 36) so that an opening at least 40 inches (e. g. at least 60 inches, preferably about 72 inches, or even more) in diameter is provided in the bottom of the drum, (k) removing coke from the drum through the bottom opening (using the conventional prior art techniques); and (l) repeating steps (e)–(g) to move and seal the bottom flange 4', 11 back into a position covering the opening in the bottom of the drum.

It will thus be seen that according to the present invention a method and assembly have been provided which allow the semi-automatic safe, quick, and effective heading and unheading of coke drums, or the like. While the invention has been herein show and described in what is presently conceived to be the most practical and preferred embodiment thereof, it will be apparent that many other modifications may be made within the scope of the invention, which scope as to be accorded the broadest interpretation of the appended claims so as to encompass all equivalent structures and methods. For example, the structures of the invention may be reduced in size by a factor of two, thus making it about 36 inches in nominal size, inverted, and applied in like form but smaller, to provide the highly desired automation of the three foot flange closure on the top of the drum.

What is claimed is:

1. A method of modifying an existing substantially vertical coke drum to semi-automate heading and unheading, the coke drum having a bottom stationary flange having a plurality of substantially vertical openings through which bolts pass, and a bottom removable flange at least forty inches in diameter and having a plurality of substantially vertical openings therein to receive the bolts which pass through the stationary flange openings and having a hydrocarbon fluid conduit therein, the method utilizing a spool piece having a generally upwardly facing annular tapered clamping surface, a plurality of clamp ring sectors each having spaced first locking surfaces and generally downwardly and upwardly annular sector tapered clamping surfaces, a plurality of second locking surfaces; a plurality of first powered actuators for moving the second locking surfaces, and a plurality of second powered actuators for moving the clamp ring sectors; said method comprising the steps of:

(a) detaching the bottom removable flange from the coke drum bottom stationary flange;

(b) forming a generally downwardly facing annular tapered clamping surface on the bottom removable flange, to produce a revised removable flange having a hydrocarbon fluid conduit therein, or replacing the bottom removable flange with a new flange having a generally downwardly facing annular tapered clamping surface and having a hydrocarbon fluid conduit therein;

(c) attaching the spool piece to the drum stationary flange;

(d) attaching the plurality of second actuators to the drum;

(e) moving the revised or new movable flange into sealing engagement with the spool piece;

(f) using the second powered actuators, moving the tapered clamping surfaces of the clamp ring sectors into contact with the tapered clamping surfaces of the spool piece and the revised or new removable flange; and (g) using the first powered actuators, moving the first locking surfaces into locking engagement with the second locking surfaces.

2. A method as recited in claim 1 wherein the tapered annular clamping surfaces of the revised or new bottom flange and spool piece have a first radius of curvature, and wherein the clamp ring sectors tapered annular sector clamping surfaces having a second radius of curvature, approximately 2–13% greater than the first radius; and wherein step (f) is practiced so as to cause a center portion only of each clamp ring sector tapered annular sector to contact the spool piece and revised or new bottom flange tapered annular clamping surfaces; and wherein step (g) is practiced to cause the clamp ring sectors to bend to cause end portions thereof to come into contact with the spool piece and revised or new bottom flange tapered annular clamping surfaces and provide the desired effective clamping force at the center portion.

3. A method as recited in claim 1 wherein step (c) is practiced by connecting the bolts from the drum flange to the spool piece using nuts.

4. A method as recited in claim 1 comprising the further steps of (h) unheading the drum by first moving the first powered actuators to move the first and second locking surfaces out of locking engagement with each other, and then (i) using the second powered actuators, moving the ring clamp sectors away from the drum while the revised or new bottom flange is supported by an external support, so that the bottom flange is free to move away from the drum upon movement of the external support.

5. A method as recited in claim 4 comprising the further steps of: (j) moving the bottom flange away from the drum so that an opening at least 40 inches in diameter is provided in the bottom of the drum, (k) removing coke from the drum through the bottom opening; and (l) repeating steps (e)–(g) to move and seal the bottom flange back into a position covering the opening in the bottom of the drum.

6. A method as recited in claim 4 wherein the first actuators comprise linear actuators connected to the first locking surfaces by a linkage, and wherein each of the linkages is connected to a ring clamp sector using a removable jamming pin; and comprising the further step (j), between steps (h) and (i), of removing the jamming pins.

7. A coke drum assembly, comprising:

a substantially vertical coke drum having a top with a removable top flange, a bottom with a stationary first sealing structure, and a movable second sealing structure larger than said removable top flange that is adapted to be moved from a first position sealingly connected to the first sealing structure, and a second position detached from the first sealing structure;

said first and second sealing structures having, respectively, first and second tapered annular clamping surfaces;

a plurality of clamp ring sectors, each sector having third and fourth tapered annular sector clamping surfaces for respectively engaging said first and second tapered annular clamping surfaces;

a plurality of first locking structures each having first locking surfaces;

second locking surfaces formed in each of said clamp ring sectors, said second locking surfaces for cooperation with said first locking surfaces to hold said clamp ring sectors to each other so that said clamp ring sectors hold said second sealing structure with respect to said first sealing structure in said first position;

a plurality of first powered actuators mounted to said ring sectors and said first locking structure for moving said first locking structures with respect to said second locking surfaces between a first position in which said clamp ring sectors are clamped together, and a second position in which said clamp ring sectors are movable apart from each other; and a plurality of second powered actuators distinct from said first actuators and connected to said clamp ring sectors to move said clamp ring sectors away from said first and second sealing structures when said first locking structure is in said second position.

8. A coke drum assembly as recited in claim 7 wherein said stationary first sealing structure comprising a bottom flange of said drum, and a spool piece extending downwardly from said bottom flange; and wherein said movable second sealing structure comprises a movable flange having a hydrocarbon fluid conduit therein.

9. A coke drum assembly as recited in claim 7 wherein said plurality of clamp ring sectors comprises three or four sectors.

10. A coke drum assembly as recited in claim 9 wherein each of said first powered actuators comprises a linear actuator, and wherein said first locking surfaces are male surfaces, and wherein said second locking surfaces are female.

11. A coke drum assembly as recited in claim 10 wherein each of said plurality of second actuators comprises a linear actuator operatively connected adjacent one end thereof to said drum and adjacent another end thereof to a said clamp ring sector.

12. A coke drum assembly as recited in claim 10 wherein each of said first powered linear actuators is connected to a said first locking structure by a linkage; and wherein said linkage is releasably connected to a said clamp ring section by a removable jam pin.

13. A coke drum assembly as recited in claim 7 wherein an annular metal gasket is disposed with one main groove or two cooperating main grooves, in said first and second sealing structures; and further comprising a relief groove formed in said main groove or grooves, and a passage connecting said relief groove to a source of steam.

14. A coke drum assembly as recited in claim 7 wherein said first and second tapered annular clamping surfaces have a first radius of curvature, and wherein the clamp ring sectors tapered annular sector clamping surfaces having a second radius of curvature, approximately 5–10% greater than the first radius so as to cause only a center portion of each clamp ring sector tapered annular sector to contact said first and second tapered annular clamping surfaces, and to cause the clamp ring sectors to bend to cause end portions thereof to come into contact with said first and second tapered annular clamping surfaces and provide the desired effective clamping force at the center portion.

15. A coke drum assembly as recited in claim 7 wherein each of said first locking structures comprises a relatively stationary locking surface spaced from a relatively movable locking surface, said relatively movable locking surface mounted on a pivotal link operatively connected a one of said first actuators.

16. A coke drum assembly as recited in claim 7 wherein said second movable sealing structure comprises a bottom flange generally circular in dimension and having a diameter of over about five feet.

17. A semi-automatic clamping assembly comprising:

a stationary first sealing structure;

a movable second sealing structure that is adapted to be moved between a first position sealingly connected to the first sealing structure, and a second position detached from the first sealing structure, said second sealing structure having a diameter of over about forty inches;

said first and second sealing structures having, respectively, first and second tapered annular clamping surfaces;

a plurality of clamp ring sectors, each sector having third and fourth tapered annular sector clamping surfaces for respectively engaging said first and second tapered annular clamping surfaces;

a plurality of first locking structures each having first locking surfaces;

second locking surfaces formed in each of said clamp ring sectors, said second locking surfaces for cooperation with said first locking surfaces to hold said clamp ring sectors to each other so that said clamp ring sectors hold said second sealing structure with respect to said first sealing structure in said first position;

a plurality of first powered actuators mounted to said ring sectors and said first locking structure for moving said first locking structures with respect to said second locking surfaces between a first position in which said clamp ring sectors are clamped together, and a second position in which said clamp ring sectors are movable apart from each other; and a plurality of second powered actuators distinct from said first actuators and connected to said clamp ring sectors to move said clamp ring sectors away from said first and second sealing structures when said first locking structure is in said second position.

18. A semi-automatic clamping assembly as recited in claim 17 wherein said first and second tapered annular clamping surfaces have a first radius of curvature, and wherein said clamp ring sectors tapered annular sector clamping surfaces have a second radius of curvature, approximately 5–10% greater than said first radius.

19. A semi-automatic clamping assembly as recited in claim 17 wherein each of said first locking structures comprises a relatively stationary locking surface spaced from a relatively movable locking surface, said relatively movable locking surface mounted on a pivotal link operatively connected a one of said first actuators.

20. A semi-automatic clamping assembly as recited in claim 17 wherein said plurality of clamp ring sectors comprises three or four sectors; wherein each of said first powered actuators comprises a linear actuator; and wherein each of said first powered linear actuators is connected to a said first locking structure by a linkage; and wherein said linkage is releasably connected to a said clamp ring section by a removable jam pin.

* * * * *